US008590666B2

(12) United States Patent
Adamson et al.

(10) Patent No.: US 8,590,666 B2
(45) Date of Patent: Nov. 26, 2013

(54) ARRAY ELEMENT RIGGING COMPONENT, SYSTEM AND METHOD

(75) Inventors: Alan Brock Adamson, Greenbank (CA); Ben Cabot, Brooklin (CA); Ewan James McDonald, Brooklin (CA)

(73) Assignee: Adamson Systems Engineering Inc., Port Perry, ON (CA)

( * ) Notice: Subject to any disclaimer, the term of this patent is extended or adjusted under 35 U.S.C. 154(b) by 399 days.

(21) Appl. No.: 12/903,925

(22) Filed: Oct. 13, 2010

(65) Prior Publication Data

US 2012/0093347 A1 Apr. 19, 2012

(51) Int. Cl.
*H04R 1/02* (2006.01)

(52) U.S. Cl.
USPC ..... 181/199; 181/30; 381/87; 381/386

(58) Field of Classification Search
USPC ..... 181/30, 148, 199; 381/87, 332, 336, 381/386, 387
See application file for complete search history.

(56) References Cited

U.S. PATENT DOCUMENTS

| | | | | |
|---|---|---|---|---|
| 6,640,924 | B2 * | 11/2003 | Messner | 181/144 |
| 7,206,427 | B2 * | 4/2007 | Simidian et al. | 381/335 |
| 7,261,180 | B1 * | 8/2007 | Faranda et al. | 181/199 |
| 7,328,769 | B1 * | 2/2008 | Adamson | 181/199 |
| 2003/0170070 | A1 | 9/2003 | Tsui et al. | |
| 2006/0210095 | A1 | 9/2006 | Monitto et al. | |
| 2008/0170735 | A1 * | 7/2008 | Engebretson et al. | 381/335 |

FOREIGN PATENT DOCUMENTS

| | | |
|---|---|---|
| EP | 2172182 | 4/2010 |

OTHER PUBLICATIONS

International Search Report. PCT/CA2011/050646. Completed Jan. 25, 2012. Mailed Feb. 24, 2012.

* cited by examiner

*Primary Examiner* — Jeremy Luks
(74) *Attorney, Agent, or Firm* — Lynn C. Schumacher; Hill & Schumacher

(57) ABSTRACT

Disclosed herein is a rigging component and method for connecting an array element in an array. The rigging component includes an elongate housing connectable to an array element; a connection link disposed within, and slidably extendable from, one end of the housing; a conduit extending into the housing from its opposite end, the conduit dimensioned to receive another connection link extending from an adjacent rigging component; and at least one latching device associated with the conduit for releasably retaining the other connection link within the conduit. Further disclosed is a system for connecting an array element in an array. The system comprises at least one rigging component having a connection link extendable to be locked at a single fixed distance and at least one rigging component having a connection link extendable to be locked at one of a plurality of fixed distances.

24 Claims, 24 Drawing Sheets

Fig. 5a
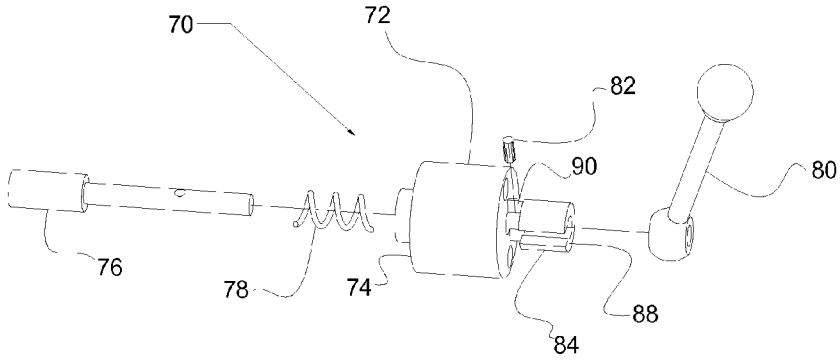
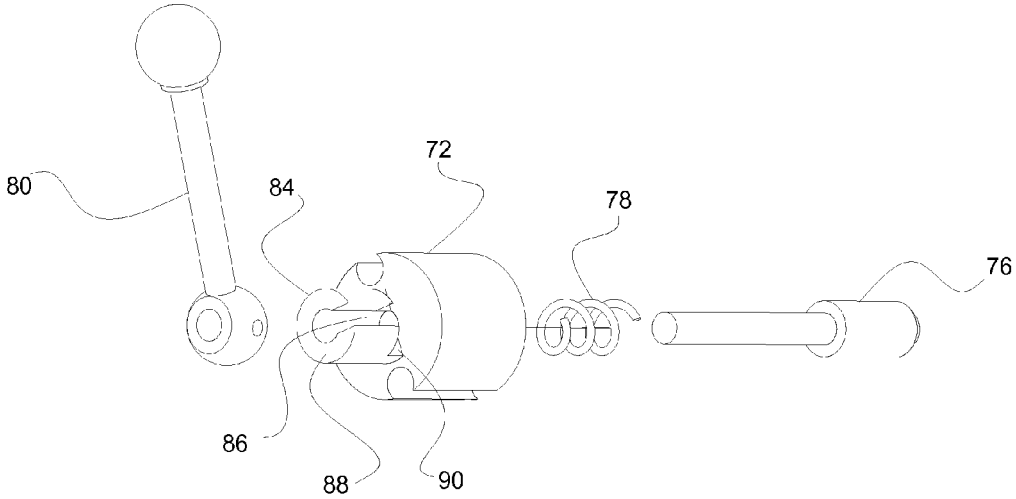
Fig. 5b

Fig. 9a
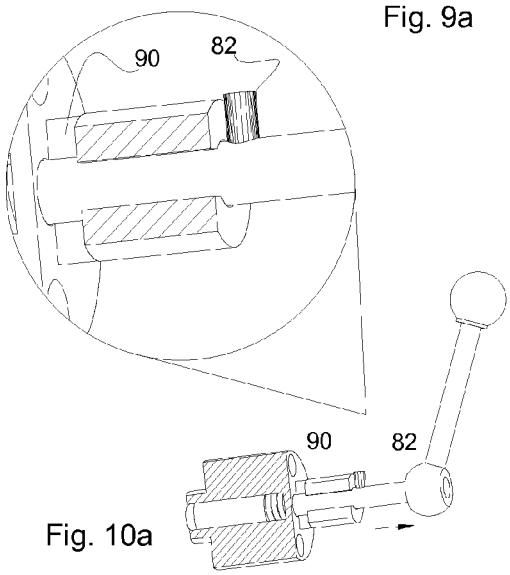
Fig. 10a
Fig. 9b
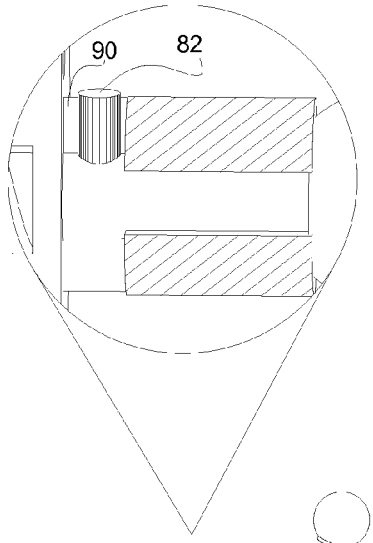
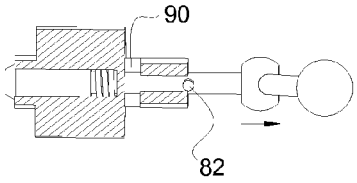
Fig. 10b
Fig. 10d
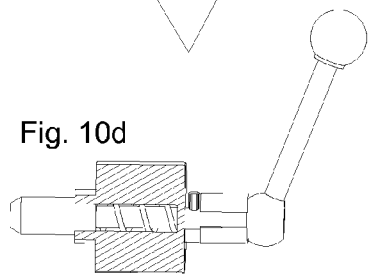
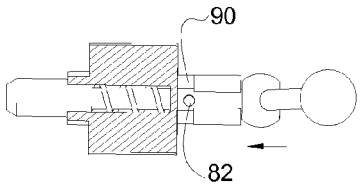
Fig. 10c
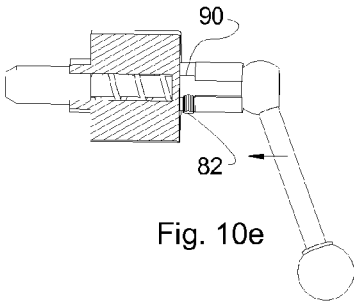
Fig. 10e

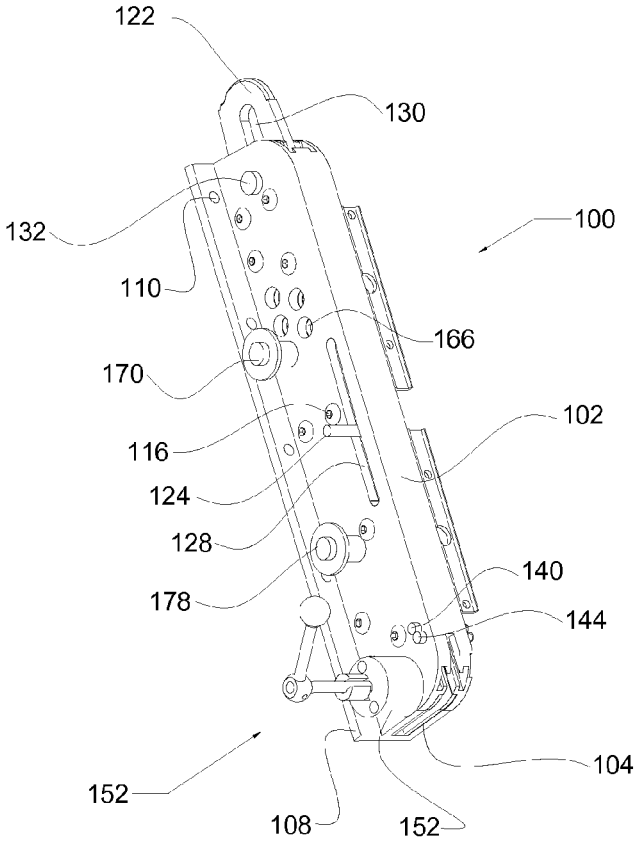
Fig. 12
Fig. 13
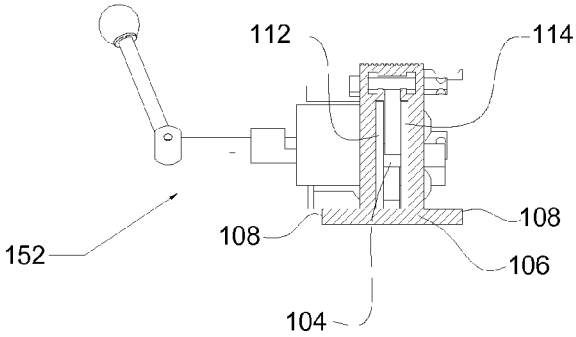

Fig. 15a
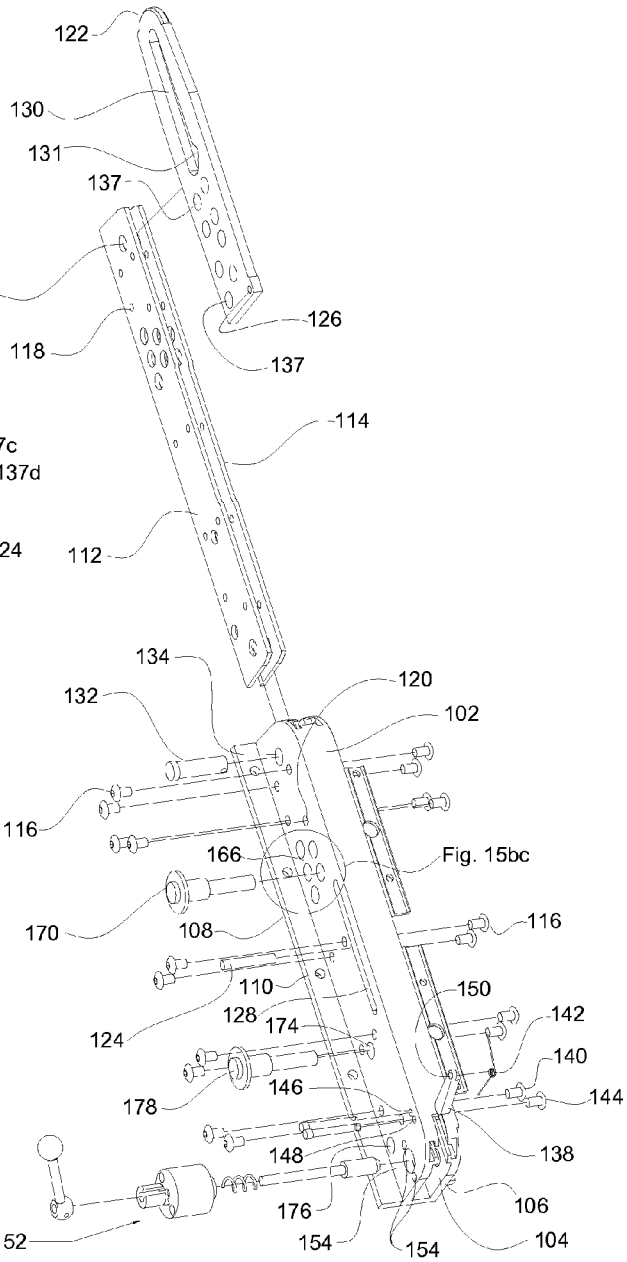
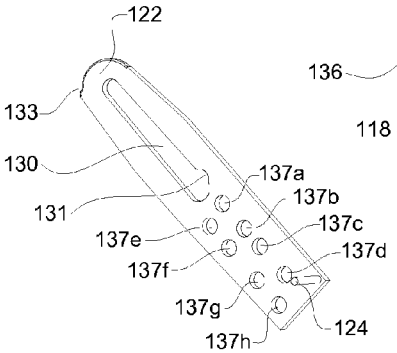
Fig. 15b
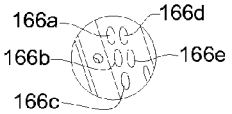
Fig. 15c

ARRAY ELEMENT RIGGING COMPONENT, SYSTEM AND METHOD

FIELD OF THE INVENTION

The invention relates generally to rigging hardware for array elements in professional loudspeaker systems and in particular to an array element rigging component, system and method therefore.

BACKGROUND OF THE INVENTION

Large arrays of loudspeaker enclosures have been standard for producing high sound pressure levels for concert production and performance installation for several decades. In that time a variety of array configurations have been developed. In the last decade the preferred large array has evolved into a single vertical array of enclosures referred to as a line array. Similar linear arrays may also be mounted horizontally, but are not referred to in the field as line arrays.

As the complexity of the loudspeaker enclosure has increased, there has been a shift in terminology in reference to the complete assembly. Each loudspeaker assembly may comprise audio transducers, enclosures which define volumes of air for related low and mid frequency transducers, horns or wave shaping sound chambers and related transducers, rigging hardware (often referred to as fly hardware), amplifiers, heat sinks, digital signal processing hardware or networking hardware or some combination of these components. Since these assemblies are then joined together to form an array of the desired geometry, functionality and performance, the more sophisticated loudspeaker enclosures are now frequently called array elements.

A person skilled in the art will realize that for the purposes of rigging applications, the terms loudspeaker enclosure and array element are interchangeable and furthermore that rigging concepts that are applied to arrays will find equal utility in simpler rigging applications.

Array elements are generally connected one to another by means of a structurally engineered rigging system attached directly to the enclosure to form the array. Rigging systems are generally comprised of adjustable metal parts allowing the desired angular relationship between the elements of the array to be achieved. The array element angle, defined by the angular relationship between array elements is commonly fixed by the use of locking structural pins.

Rigging systems are required to perform both as a hanging system and a ground stacking system. The hanging function is implemented on the largest arrays with the use of a lifting device attached to an overhead structure such as a roof of a building, a crane or a temporary staging system. The ground stacking function is generally implemented on smaller arrays and the array elements are manipulated manually. The array may be placed on the ground or on the edge of a stage or platform.

A rigging system is assembled from a variety of materials, fasteners and processes such as welding. These assemblies comprise structural load bearing members and are therefore subject to structural engineering certification by an Association of Professional Engineers somewhere in the world. All rigging systems are generally designed to meet the strictest engineering jurisdictions, since any given brand of touring and installation speakers will be used throughout many countries. European jurisdictions, regarded as the strictest, require an eight to one safety factor in the structural design of rigging systems that are used for theatrical and performance applications. Furthermore there are regulatory limitations placed on device connection and locking methods as well as the additional requirement for safety straps.

By comparison to the strict limits for the entertainment industry, the construction industry is required to meet a three to one safety factor for apparatuses such as cranes and scaffolds.

The weight of rigging assemblies can seem out of proportion to the apparent lifting requirement because of the high ratio safety factors applied. Rigging systems therefore add significant weight to array elements.

In order to achieve a curved array, rigging systems are generally devised with two sets of components, a pair of front rigging components mounted near the front of, and one or two back rigging components mounted on or near the back of the enclosure. By this method a stable curved array may be formed.

Array elements are available in two distinct cross sectional shapes: rectangular and trapezoidal. In order to form and adjust a curve with rectangular array elements a space will form between the fronts of the array elements. In this case the front rigging component will be adjustable in length and the back rigging component will be fixed in length. In order to form and adjust a curve with trapezoidal array elements a space will form between the backs of the array elements. In this case the back rigging component will be adjustable in length and the front rigging component will be fixed in length.

The desired array geometry and the required array element angles are most often determined by dedicated simulation software that predicts the likely acoustic behaviour of the array in the listening environment. Based on the simulation software the geometry is optimized prior to array assembly so that when erected (or flown) the individual array elements point at the exact prescribed locations in the listening area creating even sound pressure distribution. Because of the finite length of the array and the geometry of typical listening environments, the shape of the array is always curved and most often the curvature increases toward the lower portion of the array. A precise and predictable angular setting between the elements is therefore essential.

Assembling and erecting (or flying) of line arrays is performed with the following equipment. Typically, a welded metal structure called a rigging frame is lifted from the ground by one or more chain hoists. The array elements are connected to the underside of the rigging frame and the chain hoists are attached to a suitable overhead structure with steel cables. In some cases where the ceiling height ranges between 100 and 200 feet there is a large temporary grid framework erected for the purpose of a performance that will carry both audio and lighting equipment. The grid is suspended in like manner with steel cables. The largest arrays weigh up to 7,000 lbs including the chain hoists and frames used to pick them off the ground.

The elasticity of materials has given rise to safety problems. When stopping and starting chain hoists which are heavily loaded, the stretching of the steel support cables and the flexing of grid materials, combined with the elasticity of the rigging system causes a significant bouncing motion. Several tons will move rapidly up and down a distance of several inches. This is a significant pinching hazard and severely damaged fingers and hands are not uncommon There are roughly three different categories of methods for flying line arrays as well as ground stacking. The first method consisted of arranging the array elements face down on removable wheeled dollies that form part of the transportation equipment. The back rigging components were first joined together to form a chain. The chain of array elements was then pulled up by the hoists allowing the array elements to be swung into position and the front rigging components joined. The array element angles were established generally by the insertion of locking pins in either the front or back rigging components, as required. This procedure was referred to as a caterpillar and was dominant in the first years of line array implementation. The pinch hazard was limited to the scissor action of the elements as they were closed to join the front rigging component.

The second method is a dangerous variation on the caterpillar method and remains in use today. The practice involves attaching both the front and back rigging components and setting the array element angles while all the array elements are face down on their dollies on the ground. The rigging frame is attached to the top of the array and the chain hoists are connected to the rigging frame. Such an array might reach a length of twenty feet and weigh more than 3000 lbs.

The motors then start lifting the top end of the array. This results in the entire array being supported by the hoists on one end and the floor on the other end in a near horizontal position. While this condition exists momentarily, it is at best precarious and at worst, dangerous. Array elements and rigging components are generally suited to create a vertical array, not to form a horizontal beam.

The third method arose because the caterpillar method was considered by some to be too slow. A new form of dolly became popular where four or more array elements could be stacked in a vertical fashion and secured for transport. All the elements would remain connected at all times and lifted directly from their dolly into the array as a block of array elements. The array element angles are pre-set before lifting and the blocks identified as to their place within the array design. This block is referred to by technicians as a meat pack.

Various methods of establishing the array element angles with metal parts and structural pins have been developed. The attachment of an additional block of elements and the setting of array element angles requires the lowering of the heavy array which has been flown onto another block of elements sitting on the ground. The pinch hazard at the time of this activity is high.

A further problem arises in large curved arrays when the length of the array prevents significant backward tilting of the entire array. The fixed angles of the flown part of the array cannot be moved. The curvature of the lowermost part of the flown array results in the bottom element reaching a forward leaning angle often more than 45 degrees. Attaching further meat packs can be quite hazardous. Presently it is common to see technicians attach a pack of four array elements by the two front rigging components and then tip over the pack, which weighs more than 900 lbs, as it sits on its dolly. The array is then lowered by the hoists until the back rigging component can be joined to the tilted pack and then it is lifted from the ground.

Ground stacking can be achieved either by the placement of a block of elements on an elevated surface with a forklift which is common in shows that take place in arenas or manually lifting the elements into a stack. Ground stacks are typically four to six elements high.

In a time constrained touring environment the nature of the performance space in generally known in advance and, where possible, the software simulation will be run in advance of arrival at the venue. Once the desired array element angles are known, the required adjustment of the angles must be performed quickly and efficiently so as not to cause a delay in the commencement of array assembly.

The best practice today allows the setting of array angles in the rigging components before the flying process begins. After the process of assembly begins, technicians are still required to reach into a hazardous location and insert structural load bearing pins into the rigging components to structurally secure the weight of the array.

This process requires numerous people to move and position the blocks of elements placing their hands in a dangerous location to finalize the structural connection. This takes significant time and care raising the potential for delays in the already time constraining touring environment. All rigging systems suffer from these limitations in one form or another.

A further safety hazard is found in the lowering of arrays after the performance. The significant weight of the flown array must be lowered carefully to relieve the weight from the structural locking pins that connect the array elements allowing the release and removal of the pins. Since the rigging components are most often found on or near the ends of the array element, a coordinated effort between two technicians is required to remove the pins and to lower the elements their resting position. During this phase a continued pinch hazard exists.

In addition to the procedural and safety limitations of the state of the art rigging systems, numerous other limitations still exist.

Even though significant safety margins are observed, during transport and moving from the truck to the venue, damage may occur. Blocks of array elements are heavy, are often subjected in the concert environment to forklift activity and the array components are generally mounted on the exterior of the array element. In addition to simple physical damage, wear and tear, array element flexural stress and misuse, result in rigging components that do not fit properly. Poor fit results in extensive time loss and increased safety hazard.

Distortions in rigging components are not easily repaired while travelling from one city to another in a touring environment. Often repairs will be left undone and a variety of stop gap measures will be employed to make the array fit together. This work is carried out in an environment where the historical maxim is that the show must go on.

It is an object of an aspect of the invention to mitigate or obviate at least one of the above-described disadvantages of the prior art.

SUMMARY OF THE INVENTION

In accordance with an aspect, there is provided a rigging component for connecting an array element in an array, the rigging component comprising:

an elongate housing connectable to an array element;

a connection link disposed within, and slideably extendible from, one end of the housing;

a conduit extending into the housing from its opposite end, the conduit dimensioned to receive another connection link extending from an adjacent rigging component;

at least one latching device associated with the conduit for releasably retaining the other connection link within the conduit.

In one embodiment, the connection link is extendible to be locked at a single fixed distance. In another embodiment, the connection link is extendible to be locked at one of a plurality of fixed distances.

In one embodiment, a system for connecting an array element in an array may comprise at least one rigging component having a connection link extendible to be locked at a single fixed distance and at least one rigging component having a connection link extendible to be locked at one of a plurality of fixed distances.

In accordance with an aspect, a method for connecting first and second array elements to each other comprises:

to each of the first and second array elements:

attaching at least one first rigging component having a connection link that is extendible to be locked at a single fixed distance to the array element;

attaching at least one second rigging component having a connection link that is extendible to be locked at one of a plurality of fixed distances to the array element;

extending and locking at a selected fixed distance the connection link of the at least one second rigging component attached to the second array element;

extending and locking at the single fixed distance the connection link of the at least one first rigging component attached to the first array element; and bringing the first array element towards the second array element until corresponding first and second rigging components interconnect thereby to connect the first and second array elements to each other.

The rigging component, system and method of the invention provide advantages for improving the speed, safety and precision of forming arrays of array elements.

BRIEF DESCRIPTION OF THE DRAWINGS

Embodiments will now be described more fully with reference to the accompanying drawings in which:

FIG. 5*a* is a right hand isometric exploded view of a latching mechanism;

FIG. 5*b* is a left hand isometric exploded view of the latching mechanism;

FIG. 9*a* is an enlarged section view of a portion of the latching mechanism;

FIG. 10*a* is an isometric section and FIGS. 10*b* through 10*e* are side sections of the latching mechanism in various positions;

FIG. 12 is an isometric view of an adjustable rigging component;

FIG. 13 is an end section view of the adjustable rigging component;

FIG. 15*a* is an isometric exploded view of the adjustable rigging component;

FIG. 15*b* is an isometric view of an adjustable connection link;

FIG. 15*c* is an isolated view of a set of holes in the structural housing of the adjustable rigging component;

DETAILED DESCRIPTION OF THE EMBODIMENTS

Fixed Rigging Component

Figure 1:
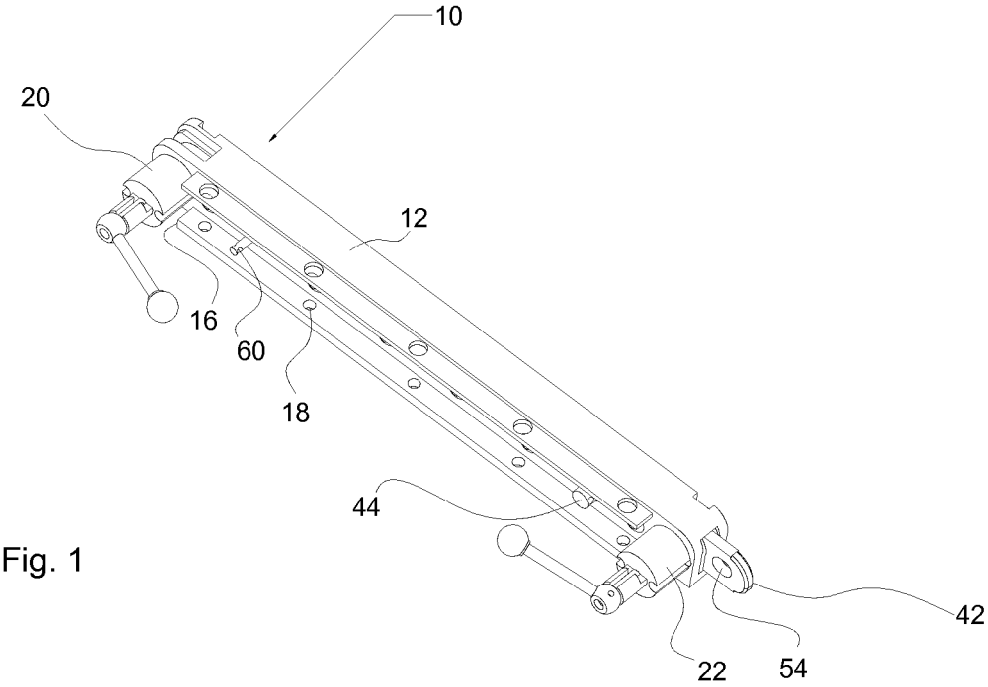
FIG. 1 is an isometric view of a fixed rigging component.

FIGS. 1 and 1*a* show a fixed rigging component (10) according to an embodiment. Fixed rigging component (10) in this embodiment is configured for attachment to an array element and also, selectively, for connection to up to two other adjacent fixed rigging components attached to respective other array elements for forming an array, as will be described. Fixed rigging component (10) is referred to as such because the distance between fixed rigging component (10) and adjacent rigging components when connected is fixed i.e., not adjustable.

In this embodiment, fixed rigging component (10) comprises a structural housing (12) that is formed as an aluminum extrusion and that has a conduit (13) disposed therethrough from a first end to a second end. An attachment interface for attaching the fixed rigging component (10) to an array element is integrated with the structural housing (12). In this embodiment, the attachment interface is in the form of a plate (16) that extends from a side of the structural housing (12) like a flange and that has mounting holes (18) for receiving fasteners such as screw or bolts therethrough for attaching the fixed rigging component (10) to the array element.

Figure 3:
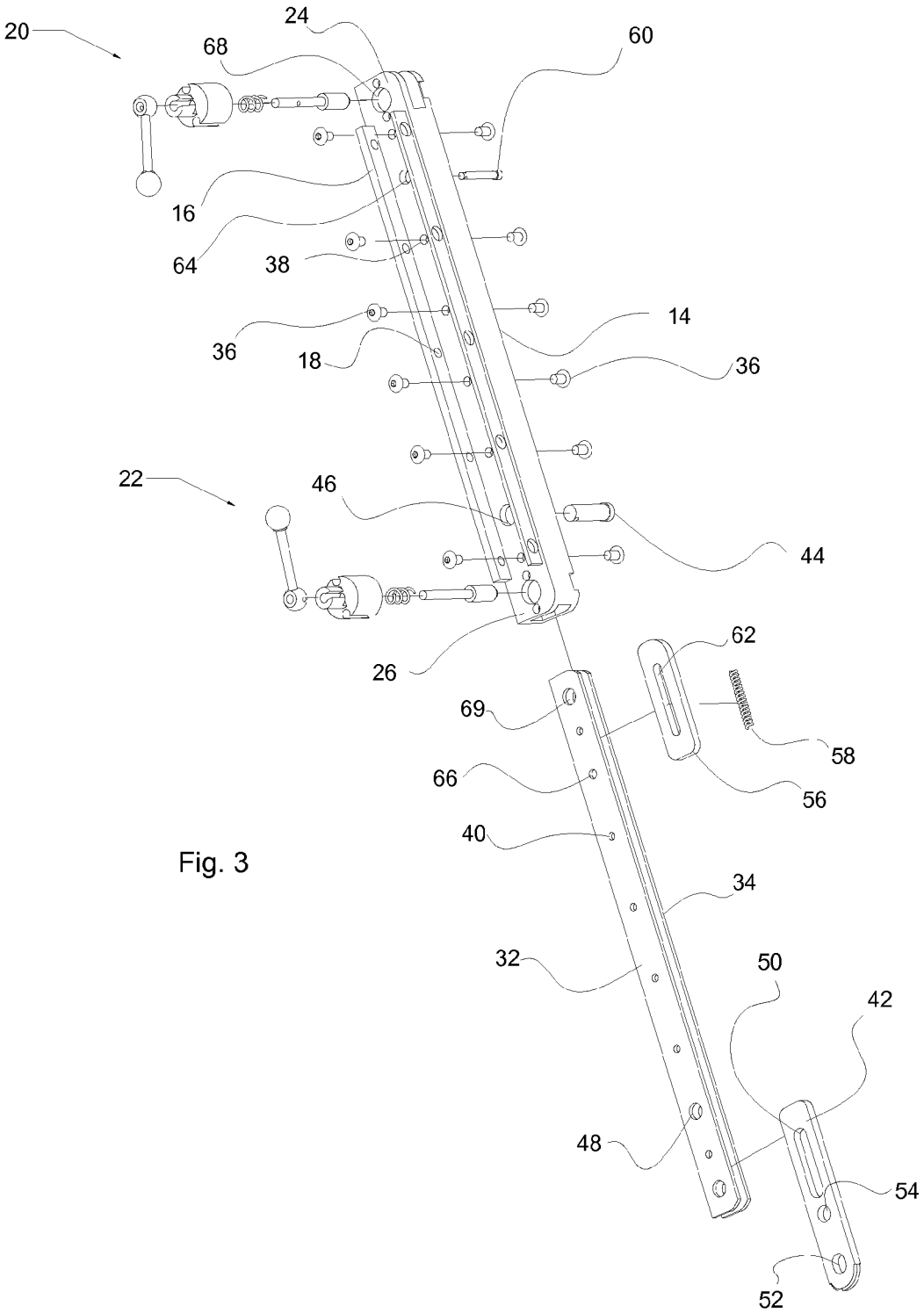
FIG. 3 is an isometric exploded view of the fixed rigging component.

As shown in FIGS. 1 and 3, fixed rigging component (10) also comprises latching mechanisms (20, 22) that are joined near the first and second ends of the structural housing (12) via respective attachment interfaces (24, 26).

Figure 2:
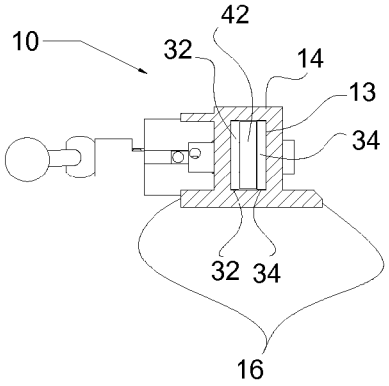
FIG. 2 is an end section view of the fixed rigging component.

As shown in FIGS. 2 and 3, two bars (32, 34) formed of heat treated high strength steel, and functioning both as reinforcement for the aluminum extruded structural housing (12) and as guides, are fixed in a spaced parallel relationship within the conduit (13). The bars (32, 34) each comprise threaded holes (40) and are fixed in their parallel position within the conduit (13) by machine screws (36) that are threaded through holes (38) in the structural housing (12) and threaded into holes (40).

Reinforcement with heat treated, high strength steel bars (32, 34) as reinforcing guides permits fabrication using aluminum of a very compact and light weight fixed rigging component that also has significant structural load-bearing capacity. Furthermore, the heat treated steel provides a low friction wear surface for guiding other components within the conduit (13) as will be described. This eases operation and extends the working life of the rigging component without undue warping or other wearing that would otherwise occur to the detriment of dimensional accuracy of the fixed rigging component (10). Furthermore, the aluminum structural housing (12) encapsulates the hardened steel bars (32, 24) and protects them from direct exposure to impact.

Disposed towards the first end of the structural housing (12) and between bars (32, 34) of fixed rigging component (10) is a fixed connection link (42) configured for insertion into, and connection to, an adjacent fixed rigging component. Disposed towards the second end and between bars (32, 34) of the structural housing (12) is a retention device (56) for interacting with a fixed connection link of an adjacent fixed rigging component upon its insertion into the second end, as will be described.

Figure 4:
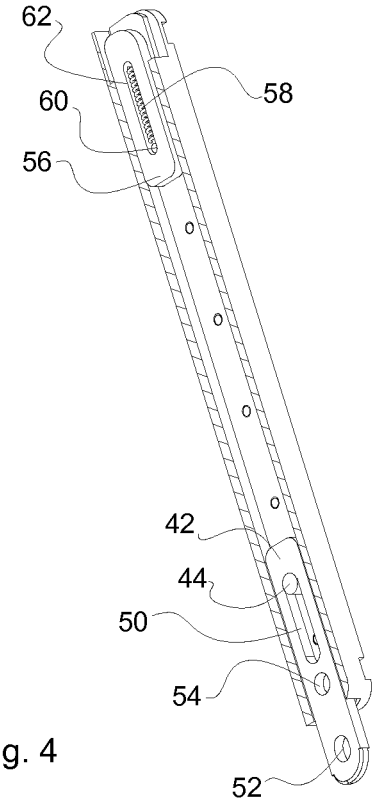
FIG. 4 is an isometric section view of portions of the fixed rigging component.

The fixed connection link (42) is formed of a hardened steel bar and is slideably disposed between the guide bars (32, 34). Sliding movement of the fixed connection link (42) both into and out of the structural housing (12) as guided by the guide bars (32, 34) is limited by a structural pin (44). As can be seen particularly in FIG. 4, structural pin (44) extends through mating holes (46) in the structural housing (12), mating holes (48) in the parallel reinforcing bars (32, 34) and an elongate slot (50) in the fixed connection link (42). The fixed connection link (42) also has a hole (52) therethrough that is sized to receive a latch pin (76) from a latching mechanism (22) of an adjacent fixed rigging component to thereby connect the fixed connection link (42) and accordingly the fixed rigging component (10) to the adjacent fixed rigging component. Furthermore, in this embodiment one additional locking hole (54) through the fixed connection link (42) permits the connection link (42) to be selectively maintained in either an extended position or a retracted position (i.e. substantially within the structural housing (12)) by the latch pin (76) of the latching mechanism (22).

The retention device (56) is also formed of a hardened steel bar and is slideably disposed between the bars (32, 34). Sliding movement of the retention device (56) within the structural housing (12) as guided by the guide bars (32, 34) is governed by the combination of a spring (58) and a clevis pin (60) or other appropriate pin which passes through an elongated slot (62) in the sliding retention device (56), holes (66) in the bars (32, 34) and holes (68) in the structural housing (12). The retention device (56) interacts with the latching mechanism (20), which itself is mounted to the attachment interface (24) over the holes (68) in the structural housing (12) that are aligned with holes (69) in the bars (32, 34), as follows. More particularly, the retention device (56) is biased by the spring (58) to be extended and thereby in a position to block the latch pin (76) of the latching mechanism (20) from entering into and passing through the conduit (13). However, the spring (58) may be compressed against its bias when the retention device (56) is pushed inward by a fixed connection link (42) of an adjacent fixed rigging component towards its retracted position. When the retention device (56) is pushed into its retracted position against the bias of the spring (58), it no longer blocks passage of the latch pin (76), which may therefore cross the conduit (13). When the latch pin (76) is permitted to cross the conduit (13), it may also pass through the hole (52) in the fixed connection link (42) of the adjacent fixed rigging component thereby to connect the fixed rigging component (10) to the adjacent rigging component.

It is preferable that the latching mechanisms (20, 22) be spring loaded in order to ease assembly of an array of array elements, as shown in FIGS. 5*a* and 5*b* and as will be described. More particularly, when the latching mechanisms (20, 22) can be arranged to automatically latch under spring bias when conditions are favourable, assembly of arrays can be done very quickly. However, it will be understood that while very useful, spring loading is not required. Furthermore, other devices for permitting connection of the fixed rigging component (10) to adjacent fixed rigging components are possible. However, description of the current embodiment will be continued below.

Figure 6:
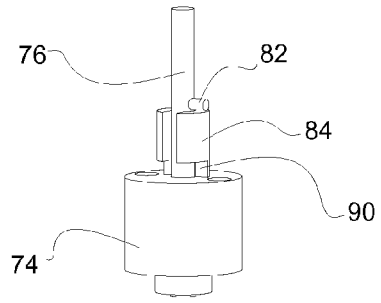
FIG. 6 is an isometric view of portions of the latching mechanism in isolation.
Figure 8:
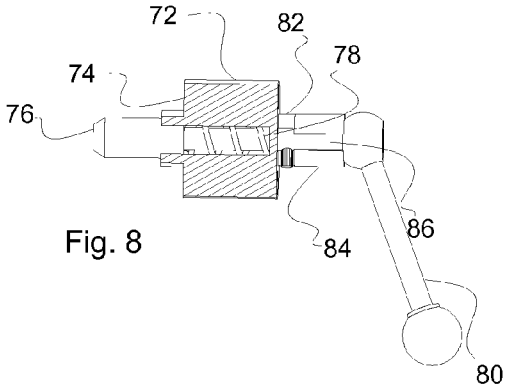
FIG. 8 is a section view of the latching mechanism.

FIGS. 5*a* and 5*b* depict an exploded view (assembly drawing) of the spring loaded latching mechanism (20, 22), referred to in the following paragraphs using reference character (70) for ease of description. The mechanism comprises a body (72) (also shown in FIG. 6 and in cross section in FIG. 8) with an integral mounting surface (74) for mounting to the attachment interfaces (24, 26) on the structural housing (12), a latch pin (76), a latch pin spring (78), a handle (80), a latch pin locking stud (82) attached perpendicularly to the latch pin (76) and a latch pin locking barrel (84). The locking barrel has a slot (86), an inside notch (90) and an outside end (88).

The handle (80) allows an operator to engage and disengage the latch pin (76) and to rotate the handle (80) for the purpose of engaging and disengaging the latch pin and for locking and unlocking the latching mechanism (70). The latch pin (76) slides axially in the latching mechanism body (72) and can extend beyond the body (72). The spring (78) causes the pin (76) to be biased axially outwardly from the body (72). The locking stud (82) allows the axial movement of the pin (76) to be held either in an engaged or a disengaged position.

Figures 7A, 7B, 7C, 7D:
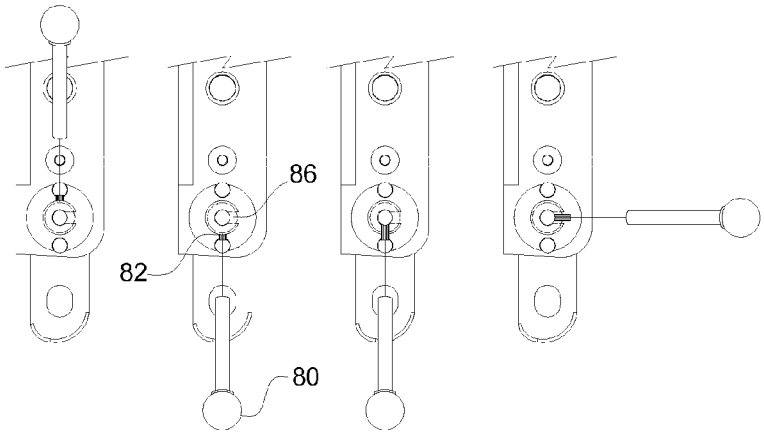
FIGS. 7*a* through 7*c* are side views of the latching mechanism on a structural housing of the fixed rigging component in various positions.

In FIG. 7*a* the locked position of the latching mechanism (70) is shown. As can be seen, the locking stud (82) is placed in the inside notch (90) preventing the latch pin (76) from moving axially. In FIG. 7*b* the unlocked position of the latching mechanism (70) is shown. In this position the locking stud (82) is resting on the outside end (88) of the locking barrel (84). In FIG. 7*c* the neutral position of the latching mechanism (70) is shown. In this position the locking stud (82) is placed in the barrel slot (86) allowing axial movement either manually by the operator or under the bias of the latch pin spring (78).

FIGS. 9*a* and 9*b* further illustrate the movement of the latch pin (76) and the function of the locking stud (82).

Due to its construction as described above, the latching mechanism (70) may be placed in four key positions, as shown in FIGS. 10*a* through 10*d*.

The first position in which the latching mechanism (70) may be placed is shown in FIG. 10*a*. This position is achieved by unlocking the latch pin (76) upon rotation of the handle (80) so that the locking stud (82) moves out of the inside notch (90) and into the slot (86) in the locking barrel (84). The latch pin (76) can then be retracted into the disengaged position (see arrow) and the handle (80) rotated so that the locking stud (82) rests on the outside end (88) of the locking barrel (84). This leaves the latching mechanism (70) in the disengaged and locked position.

The second position in which the latching mechanism (70) may be placed is shown in FIG. 10*b*. This position is achieved in conjunction with the retention device (56) by rotating the handle (80) so that the locking stud (82) moves into the slot (86). The handle is then released and the latch pin (76) is biased forward by the latch pin spring (78) until it makes contact with the retention device (56). As described above, unless the retention device (56) has been moved to its retracted position, it prevents the latch pin (76) from crossing the conduit (13). This leaves the latching mechanism (70) in its disengaged and loaded position.

The third position in which the latching mechanism (70) may be placed is shown in FIG. 10*c*. This position is achieved when the retention device (56) has been caused to move against its own spring bias to a retracted position at which holes (66, 68) are not obstructed. When this is done, the latch pin (76) of the latching mechanism (70) is free to cross through the holes (66, 68) under the bias of the spring (78) (or manually by the operator applying pressure on the handle (80)) to cause the latch pin (76) to slide axially through the latching mechanism body (72). With the latch pin (76) having crossed through the holes (66, 68), the latching mechanism (70) is in the engaged and unlocked position.

The fourth position in which the latching mechanism (70) may be placed is shown in FIG. 10*d*. This position is achieved when the handle (80) is manually rotated such that the lock stud (82) is positioned securely within the inside notch (90) of the locking barrel (84). This leaves the latching mechanism (70) in the engaged and locked position.

The fifth position in which the latching mechanism (70) may be placed is shown in FIG. 10*e*. The latch mechanism (70) in FIG. 10*e* is in the engaged and locked position, however with the handle (80) in the downward position as opposed to the upward position shown in FIG. 10*d*. It will be understood that the position of handle (80) shown in FIG. 10*e* is functionally equivalent to the position of handle (80) shown in FIG. 10*d*, since whether upward or downward the latch mechanism (70) is in the engaged and locked position.

In the preferred embodiment the spring loaded latching mechanism (70) is used on both the fixed rigging component (10) (referred to in this context as latching mechanisms 20, 22) and on the adjustable rigging component (100) (referred to in this context as latching mechanism 152).

The fixed rigging component (10) described above may be conveniently assembled and tested in the manufacturing environment without being attached to an array element. Furthermore, replacement or repair of the fixed rigging component (10) is facilitated by the ease of detachment of the structural housing (12) from the array element in the field.

Fixed Rigging Component Operation

The following is a description of the connection of two fixed rigging components to each other, in a sequence of operations having four main steps. For clarity the four main steps in the sequence of operations are depicted using illustrations of portions of two fixed rigging components (92, 94) positioned adjacent to one another. Fixed rigging components (92, 94) are each identical to fixed rigging component (10) described above. In FIGS. 11*a* through 11*d* portions of the fixed rigging components (92, 94) are shown in cutaway form exposing the conduit (13), one of the parallel bars (34), the fixed connection link (42), the sliding retention device (56) and its associated spring (58).

Figure 11A:
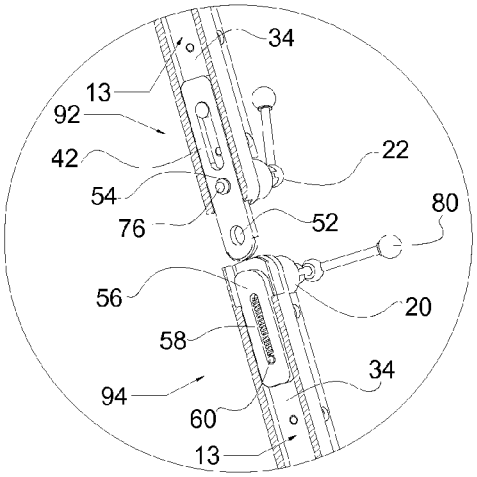
FIGS. 11*a* through 11*d* are isometric section views of the fixed rigging component being connected to an adjacent fixed rigging component.

FIG. 11*a* depicts fixed rigging component (92) positioned above fixed rigging component (94) just prior to engagement and connection. The handle (80) of the latching mechanism (20) is positioned perpendicular to the fixed rigging component (94) and is therefore in its disengaged and loaded position as described above with reference to FIG. 10*b*.

The latch pin (76) of the spring loaded latching mechanism (22) of fixed rigging component (92) has been inserted through the locking hole (54) of the fixed connection link (42). As a result, the fixed connection link (42) of fixed rigging component (92) has been fixed at an extended position thereby exposing its connection hole (52).

The sliding retention device (62) of the lower fixed rigging component (94) is biased to its extended position within the structural housing (12) by the spring (58) and maintained in the extended position by the clevis pin (60). The spring-loaded latch pin (20) of the latching mechanism (20) of the fixed rigging component (94) is thus blocked from crossing the conduit (13).

Figure 11B:
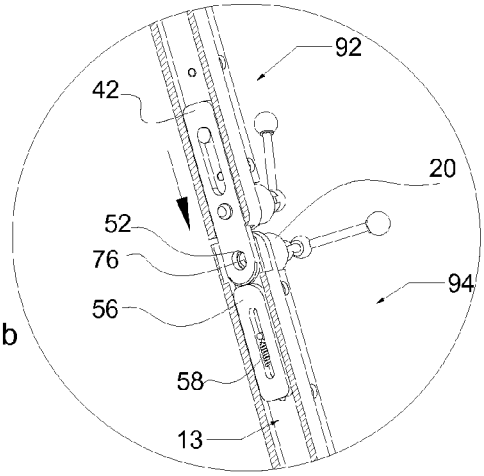

FIG. 11*b* depicts the fixed rigging component (92) having been moved downwards towards the fixed rigging component (94) in the direction shown by the arrow. In the position shown, the extended connection link (42) of the fixed rigging component (92) has been inserted into the conduit (13) of the fixed rigging component (94) between the bars (32, 34) and has pushed the sliding retention device (56) further into the conduit (13) against the bias of spring (58) towards the retracted position of the retention device (56). In the retracted position, the latch pin (76) of the spring loaded latching mechanism (20) of fixed rigging component (94) is aligned with the hole (54) in the connection link (42).

Figure 11C:
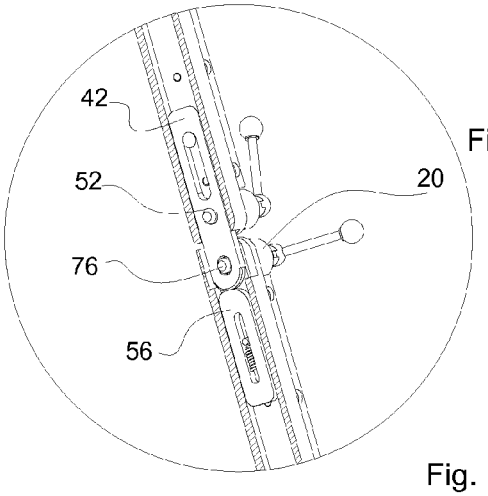

FIG. 11*c* depicts the latch pin (76) of the spring loaded latching mechanism (20) of the fixed rigging component (94) having moved forward under its spring bias and having also passed across the conduit (13) and through the hole (52) in the connection link (42) of fixed rigging component (92). This is the engaged and unlocked position depicted in FIG. 10*c*. It will be understood that the position of the latch pin (76) shown in FIG. 11*c* is assumed automatically under the bias of spring (78) of latching mechanism (20) as soon as the retention device (56) is retracted as shown in FIG. 11*b*.

Figure 11D:
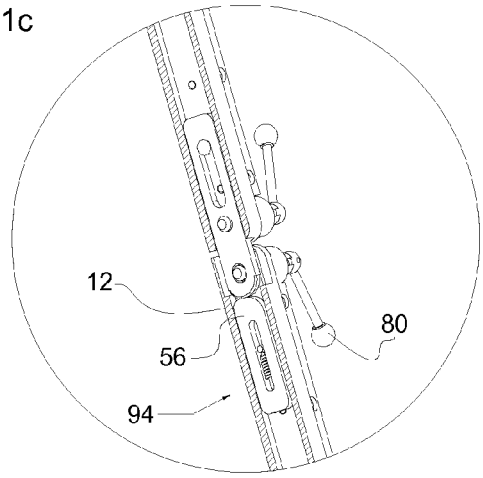

FIG. 11*d* depicts the handle (80) of latching mechanism (20) having been rotated so as to be parallel with the structural housing (12) of the lower fixed rigging component (94) leaving it in the engaged and locked position as shown in FIG. 10*d*.

Adjustable Rigging Component

FIG. 12 shows an adjustable rigging component (100) according to an embodiment. Adjustable rigging component (100) in this embodiment is configured for attachment to an array element and also, selectively, for connection to up to two other adjacent adjustable rigging components attached to respective other array elements for forming an array, as will be described. Adjustable rigging component (100) is referred to as such because the distance when connected between adjustable rigging component (100) and adjacent adjustable rigging components is adjustable as will be described.

In this embodiment, adjustable rigging component (100) comprises a structural housing (102) that is formed as an aluminum extrusion and that has a conduit (104) therethrough from a first end to a second end. An attachment interface for attaching the adjustable rigging component (100) to an array element is integrated with the structural housing (102). In this embodiment, the attachment interface is in the form of a plate (108) that extends from a side of the structural housing (102) like a flange and that has mounting holes (110) for receiving fasteners such as screws or bolts therethrough for attaching the adjustable rigging component (100) to the array element.

Figure 14:
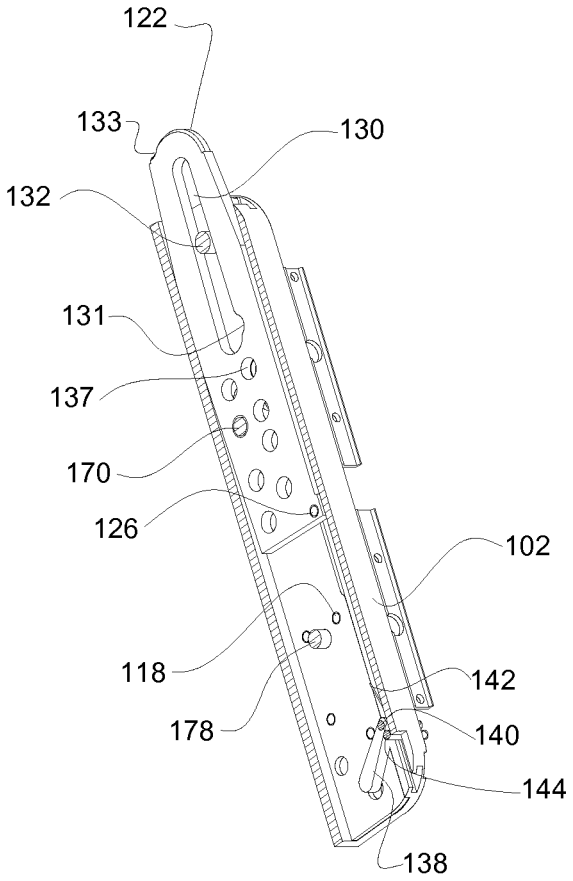
FIG. 14 is an isometric section view of portions of the adjustable rigging component.

As shown in FIGS. 14 and 15*a*, two bars (112, 114) formed of heat treated high strength steel, and functioning both as reinforcement for the aluminum extruded structural housing (102) and as guides, are fixed in a spaced parallel relationship within the conduit (104). The bars (112, 114) each comprise threaded holes (118) and are fixed in their parallel position within the conduit by machine screws (118) that are passed through holes (120) in the structural housing (102) and threaded into the holes (118).

As described above in connection with the fixed rigging component (10), reinforcement in the adjustable rigging component (100) with heat treated, high strength steel bars (112, 114) as reinforcing guides permits fabrication using aluminum of a very compact and light weight adjustable rigging component (100) that also has significant structural load-bearing capacity. Furthermore, the heat treated steel provides a low friction wear surface for guiding other components within the conduit (104) as will be described to permit ease of operation and extend the working life of the rigging component without undue warping or other wearing that would otherwise occur to the detriment of dimensional accuracy of a rigging component.

Disposed within the second end of the structural housing (102) and between bars (112, 114) is an adjustable connection link (122) configured for insertion into, and connection to, an adjacent adjustable rigging component. Disposed within the first end and between bars (112, 114) of the structural housing (102) is a rotatable retention device (138) for interacting with an adjustable connection link of an adjacent adjustable rigging component upon its insertion into the first end, as will be described.

The adjustable connection link (122) is formed of a hardened steel bar and is slideably disposed between the guide bars (112, 114). The adjustable connection link (122) is shown in isolation in FIG. 15*b*. Sliding movement of the adjustable connection link (122) both into and out of the structural housing (102) as guided by the bars (112, 114) may be controlled using a positioning handle (124) that is attached to the connection link (122) and that protrudes through a slot (128) in the structural housing (102). In this embodiment, the positioning handle (124) has a threaded end that is threaded into a hole (126) in the adjustable connection link (122). The adjustable connection link (122) has a slot (130) near its distal end and is prevented from sliding all the way out of conduit (104) by a structural pin (132) that passes through mating holes (134) in the structural housing (102), mating holes (136) in the parallel bars (112, 114) and the slot (130) in the adjustable connection link (122). The slot (130) permits the adjustable connection link (122) to slide within the conduit (104) so as to extend the adjustable connection link (122) outside of the structural housing (102) for connection to an adjacent adjustable rigging component.

The rotatable retention device (138) is formed of hardened steel and is pivotable between the bars (112, 114) about a clevis pin (140) but is prevented from full rotation about the clevis pin (140) by a stop pin (144). The clevis pin (140) passes through a hole (146) in the housing (102) and a hole in the retention device (150). The stop pin (144) passes through a hole (150) in the housing (102). The rotatable retention device (138) is biased to rotate to a blocking position against the stop pin (144) by a spring (142) that also bears against the structural housing (102) for its support.

The retention device (150) interacts with a latching mechanism (152) that is joined near the first end of the structural housing (102) via an attachment interface (154) as shown in FIG. 15. More particularly, the retention device (150) is biased by the spring (142) to block holes (154) and (160) and thereby blocks the latch pin (76) of the latching mechanism (152) from entering into the holes (154, 160) and passing through the conduit (104). However, the spring (142) may be rotated against its bias about the clevis pin (140) when the retention device (150) is pushed inward by an adjustable connection link of an adjacent adjustable rigging component towards a retracted position. When the retention device (138) is pushed to a retracted position against the bias of the spring (142), it no longer blocks passage of the latch pin (76), which may therefore cross the conduit (104). When the latch pin (76) is permitted to cross the conduit (104), it may also pass through the slot (130) in the adjustable connection link of the adjacent adjustable rigging component thereby to connection the adjustable rigging component to the adjacent adjustable rigging component.

The attachment interface (154) comprises threaded holes (156) for fixing the latching mechanism (152) on one side of the structural housing (102) and holes (158) through the structural housing (102) to allow the latch pin (76) to cross through the conduit (104) and the walls of the structural housing (102). Mating holes (164) are provided in the parallel bars that align with the latch pin (76).

The adjustable rigging component (100) is referred to as such because the distance when connected between adjustable rigging component (100) and adjacent adjustable rigging components is adjustable. The adjustability is provided in part by a group (166) of five holes (166*a* through 166*e*) in the structural housing (102) as shown in detail in FIG. 15*c*, and an aligned set of five holes (168) in the parallel bars allow a pin, in this embodiment a spring ball lock pin (170), to pass perpendicularly through the housing (102), conduit (104) and one of the eight holes (137*a* to 137*h*) in the adjustable connection link (122), as will be described in further detail below.

Two additional holes (174, 176) pass through the structural housing (102) and the parallel bars (112, 114) allowing an additional spring ball lock pin (178) to be placed in either one of the holes (174, 176) to lock the adjustable connection link (122) at a particular position for the purpose of assembling a ground stacked array of elements, as will be described.

The set (137) of holes (137*a* to 137*h*) in the adjustable rigging component and the set (166) of holes (166*a* through 166*e*) through the structural housing (102) are used to extend and fix the adjustable connection link (122) at one of eight different extension lengths upon the insertion of a spring ball lock pin (170). The two arrays of holes are arranged to provide this adjustability so that an angle can be selected from a range of possible angles between array elements as desired during erection (ie. flying or ground stacking) of an array. It will be understood that, while eight lengths have been provided in this embodiment, the invention does not require this many fixed lengths and similarly is not limited to this number.

As can be seen particularly in FIG. 15*b*, the slot (130) is provided with a widened portion (131), providing an area through which the ball lock pin (170) can pass through the adjustable connection link (122) and into the lowermost hole (166*e*) in the housing (12) when the link (122) is in the fully retracted position.

As can also be seen in FIG. 15*b*, a recess (133) is provided in the distal end of the adjustable connection link (122). The recess (133) is sized and positioned to be seated against the spring ball lock pin of an adjacent adjustable rigging component in order to, as will be described, limit the extent to which the adjustable connection link (122) can be inserted into the adjacent adjustable rigging component.

Adjustable Rigging Component Operation

The following is a description of the connection of two adjustable rigging components to each other. There are three main methods by which this may be done. The first two methods—automatic latching and manual latching—are related to flying an array. The third method relates to ground stacking of an array. For clarity the steps in the methods are depicted using illustrations of portions of two adjustable rigging components (180, 182) positioned adjacent to each other. Adjustable rigging components (180, 182) are each identical to adjustable rigging component (100) described above. In FIGS. 16*a* through 16*e*, 17*a* through 17*f*, and 18 components of the adjustable rigging components (180, 182) are shown in cutaway form for ease of understanding.

Automatic Latching Connection Method

Figure 16A:
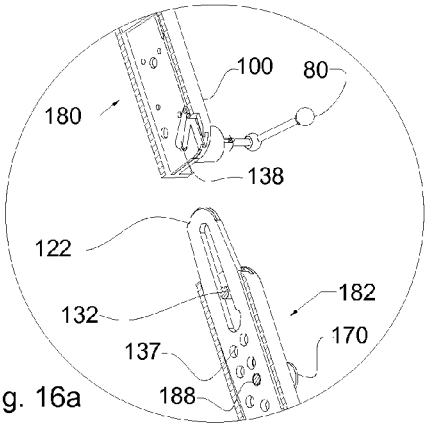
FIGS. 16*a* through 16*e* are isometric section views of the adjustable rigging component being connected to an adjacent adjustable rigging component during automatic latching.

FIG. 16*a* depicts adjustable rigging component (180) positioned above adjustable rigging component (182) just prior to engagement and connection. The handle (80) of the latching mechanism (152) is positioned perpendicular to the adjustable rigging component (180) and is in its disengaged and loaded positioned, as described above with reference to FIGS. 10*b* and 7*d*. More particularly, the rotatable retention device (138) is positioned to block the latch pin (76) from crossing into the conduit (104).

Prior to insertion into adjustable rigging component (180), the adjustable connection link (122) of adjustable rigging component (182) is extended out of its top end using handle (124) and is fixed into an extended position by insertion of the ball lock pin (170) through the structural housing (102) and into one of the eight holes (137) in the connection link (122). More particularly, the hole in the set of holes (137) into which the ball lock pin (170) is inserted is selected according to the angle with respect to the adjacent adjustable rigging component (180) that is required. The slot (130) is accordingly exposed.

Figure 16B:
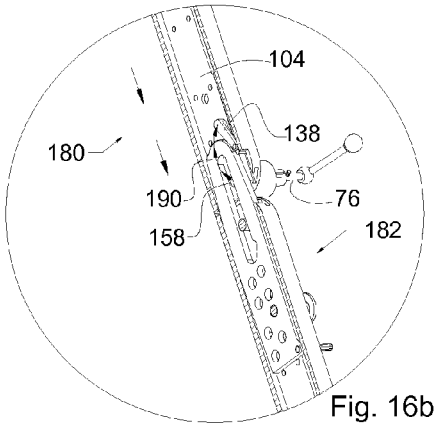

FIG. 16*b* shows the adjustable rigging component (180) having been moved downwards towards the adjustable rigging component (182) in the direction shown by the arrows. In the position shown in FIG. 16*b*, the extended connection link (122) of the adjustable rigging component (182) has been inserted into the conduit (104) of the adjustable rigging component (180) between the bars (112, 114). At this point, the extended connection link (122) has caused the rotatable retention device (138) to rotate about the clevis pin (140) to a retracted position in a manner shown by the curved arrows. In this position, the slot (130) of the connection link is aligned with the latch pin (76) of the latching mechanism (152), and the holes (158) in the structural housing (100) and corresponding holes in the bars (112, 114) are no longer blocked. The latch pin (76) having been in its disengaged and loaded position is now able, under its spring bias, to pass across the conduit (104) and through the slot (130) in the adjustable connection link (122) of the adjustable rigging component (182). It will be noted that the adjustable connection link (122) of the adjustable rigging component (182) can travel past the point that is necessary to allow the latch pin (76) to enter the slot (130). In fact, the adjustable rigging components (180, 182) can continue to come together unimpeded until the point at which their respective structural housings (102) contact one another.

Figure 16C:
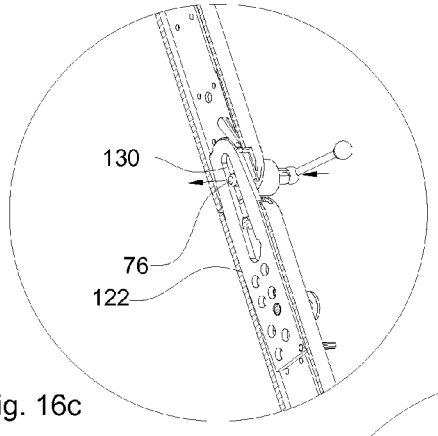

FIG. 16*c* depicts the latch pin (76) of the spring loaded latching mechanism (20) of the adjustable rigging component (180) having moved forward under its spring bias and passed across the conduit (104) and through the slot (130) in the adjustable connection link (122) of the adjustable rigging component (182) as shown by the arrows. This is the engaged and unlocked position depicted in FIGS. 10*c* and 7*d*. It will be understood that the position of the latch pin (76) shown in FIG. 16*c* is assumed automatically under the bias of spring (78) of the latching mechanism (20) as soon as the rotatable retention device (138) is retracted as shown in FIG. 16*b*.

Figure 16D:
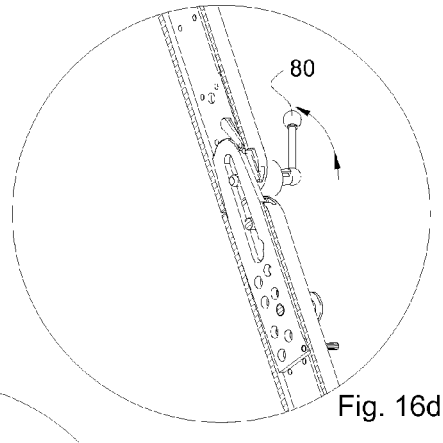

FIG. 16*d* depicts the handle (80) of latching mechanism 20 having been rotated to its engaged and locked position as shown in FIGS. 10*e* and 7*a*. It will be understood that there is no functional difference between FIGS. 10*d*, 10*e* and 7*a*, 7*b* as regards handle position for an engaged and locked position; whether the handle is positioned up or down is a matter of utility and convenience.

Figure 16E:
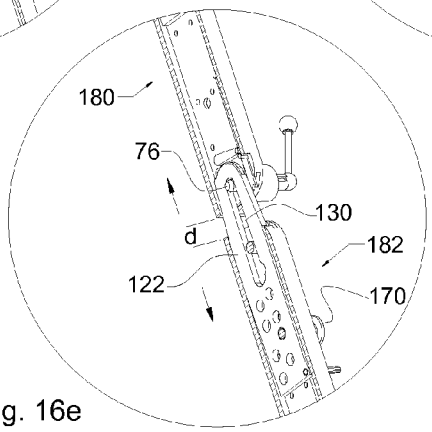

FIG. 16*e* shows the structural housings (102) of the adjustable rigging components (180, 182) having been separated in the direction shown by the opposing arrows and to a distance limited by the latch pin (76) having contacted the top of the slot (130) in the adjustable connection link (122) of the adjustable rigging component (182). The distance (d) between the components (180, 182) is governed by the amount the adjustable connection link (122) has been extended from the adjustable rigging component (182). The two components (180, 182) are now in a position to bear a load.

Manual Latching Method

One difference between the automatic latching method as described above and the manual latching method is that, with the manual latching method, the adjustable connection link (122) is not extended prior to the respective structural housings of the adjustable rigging components (180, 182) being positioned adjacent to each other.

Figure 17A:
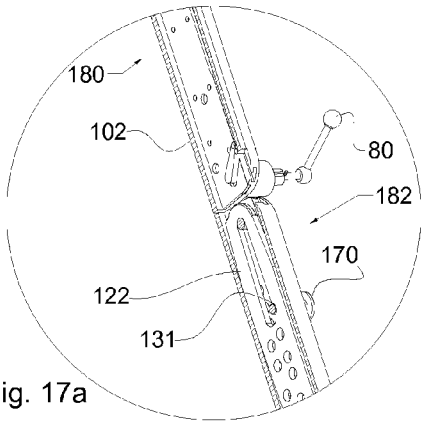
FIGS. 17*a* through 17*f* are isometric section views of the adjustable rigging component being connected to an adjacent adjustable rigging component during manual latching.

More particularly, as shown in FIG. 17*a* the adjustable rigging component (180) is placed close to, and is aligned with, the adjustable rigging component (182) with the handle (80) of the latching mechanism positioned in its disengaged and loaded position as shown in FIGS. 10*b* and 7*d*. In FIG. 17*a*, the ball lock pin (170) is in its storage position whereby it passes through the widened portion (131) of the adjustable connection link (122).

Figure 17B:
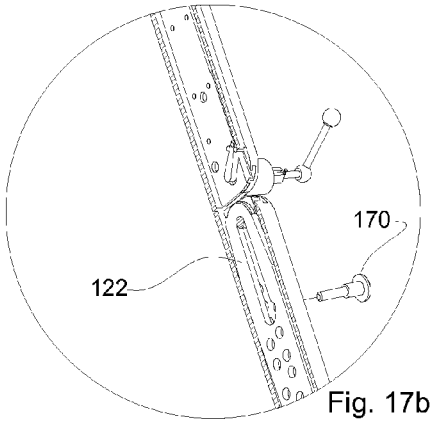

In FIG. 17*b* the ball lock pin (170) is shown having been removed from its storage position. With the ball lock pin (170) having been removed from its storage position, the adjustable connection link (122) may be moved within the conduit (104).

Figure 17C:
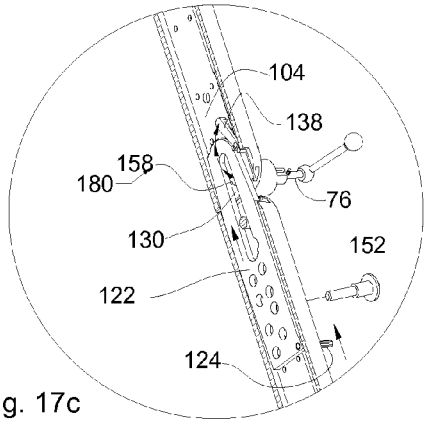

In FIG. 17*c* the connection link (122) is being extended out of the conduit (104) of the adjustable rigging component (182) in the direction of the arrows and into the conduit (104) of the adjustable rigging component (180) by moving the link adjustment handle (124) of the adjustable rigging component (182) upward to align the latch pin (76) of the latching mechanism (152) with a portion of the slot (130) of the adjustable connection link (122).

The insertion of the adjustable connection link (122) into the conduit (104) between bars (112, 114) of the adjustable rigging component (180) causes the retention device (138) to rotate about the clevis pin (140) to a retracted position as described above. In this position, the slot (130) of the connection link (122) is aligned with the latch pin (76) of the latching mechanism (152), and the holes (158) in the structural housing (100) and corresponding holes in the bars (112, 114) are no longer blocked. The latch pin (76) having been in its disengaged and loaded position is now able, under it spring bias, to pass across the conduit (104) and through the slot (130) in the adjustable connection link (122) of the adjustable rigging component (182).

Figure 17D:
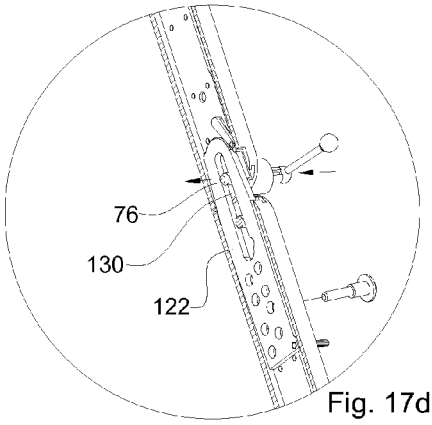

FIG. 17*d* depicts the latch pin (76) of the spring loaded latching mechanism (20) having moved forward under its spring bias and passed across the conduit (104) and through the slot (130). This is the engaged and unlocked position depicted in FIGS. 10*c* and 7*d*.

Figure 17E:
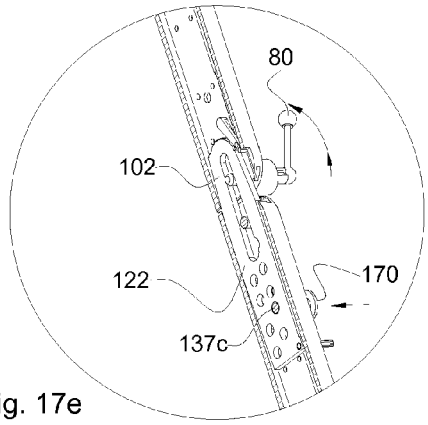

FIG. 17*e* depicts the ball lock pin (170) having been inserted through both the structural housing (102) and one of holes (137*c*) in the set (137) in the adjustable connection link (122). With the ball lock pin (170) having been inserted in this manner, the adjustable connection link (122) is fixed for a desired distance (d) to result in the desired array element angle position.

In FIG. 17*e*, the handle (80) has been manually rotated so as to put the latching mechanism (20) in its engaged and locked position.

Figure 17F:
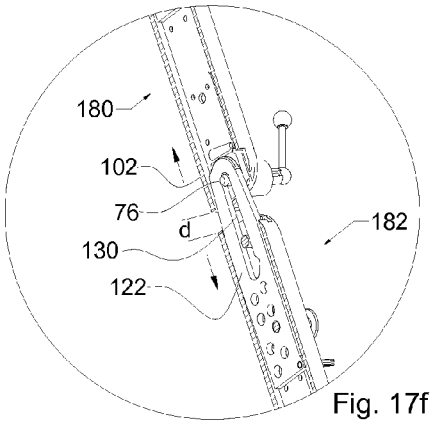

FIG. 17*f* shows the structural housings (102) of the adjustable rigging components (180, 182) having been separated in the direction shown by the opposing arrows and to a distance limited by the latch pin (76) having contacted the top of the slot (130) in the adjustable connection link (122) of the adjustable rigging component (182). The distance (d) between the components (180, 182) is governed by the amount the adjustable connection link (122) has been extended from the adjustable rigging component (182). The two components (180, 182) are now in a position to bear a load.

Ground Stacking of an Array

The fixed rigging component procedure for ground stacking array elements is the same as described in FIGS. 11*a* through 11*d*.

The adjustable rigging component procedure for ground stacking array elements is the same as described in FIGS. 17*a* through 17*f* with one additional procedure.

As previously described, the adjustable connection link (122) can move within the limits set by the latch pin (76) within the slot (130). When the components (180, 182) are placed in tension and separated as shown in FIGS. 16*e* and 17*f* the dimension (d) is established by the position of the spring ball lock pin (170) in one of the holes (137). In the case of a rigging system that is stacked, or supported from below, the adjustable rigging components (180, 182) will remain in the position shown in FIGS. 16*d* and 17*e*. That is, the structural housings (102) of the adjustable rigging components (180, 182) will normally be in contact with each other.

Therefore, in order to fix the dimension (d) for providing desired angles when ground stacking additional features are provided. In particular, an additional hole (176) through the structural housing (102) as shown in FIG. 15*a* is provided, as are corresponding holes (184) in the bars (112, 114). Furthermore, the recess (133) is provided in the top of the adjustable connection link (122) and a ball lock pin (178) stored in the hole (174) while not in use can be removed and placed through the additional hole (176).

Figure 18:
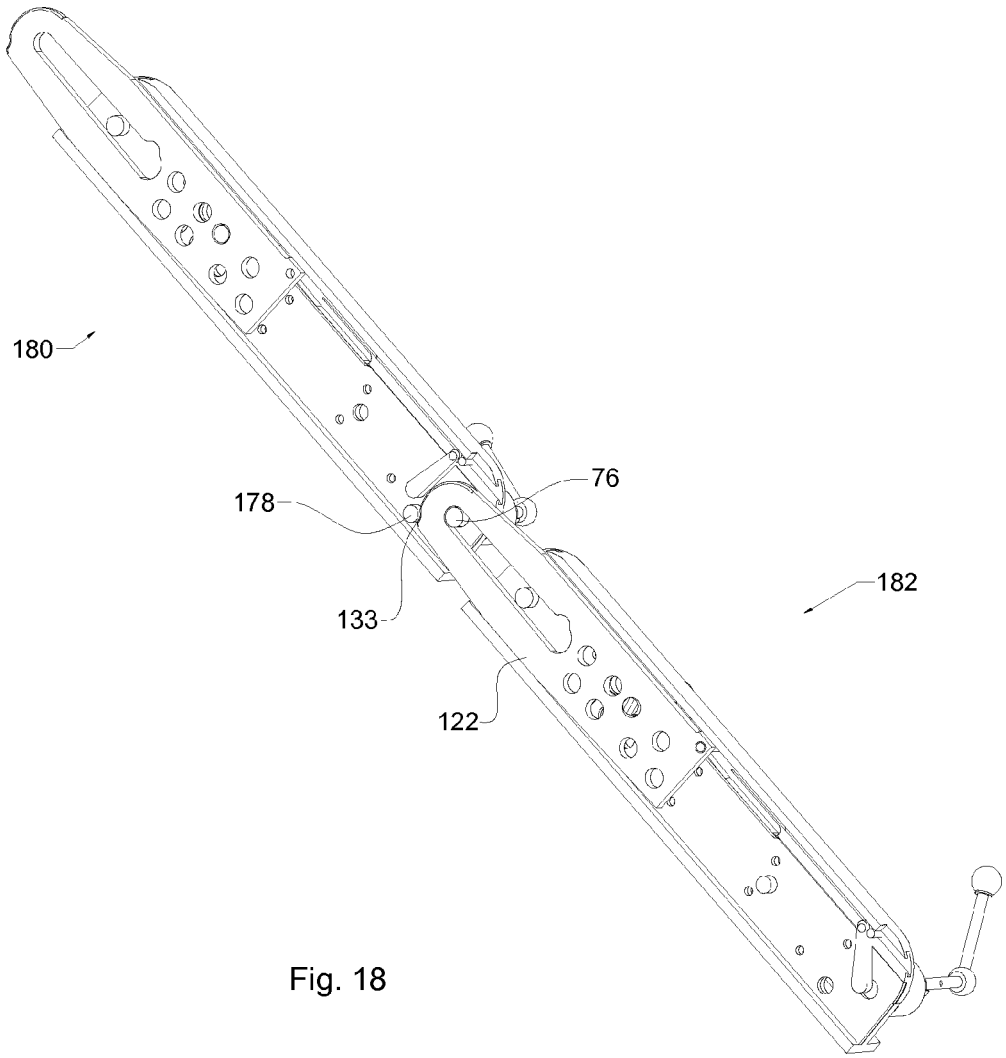
FIG. 18 is an isometric section view of the adjustable rigging component connected to an adjacent adjustable rigging component during ground stacking.

FIG. 18 shows a cutaway view of adjustable rigging components (180, 182) connected with the ball lock pin (178) having been inserted through the structural housing (102) of component (180). The ball lock pin (178) inserted through structural housing (102) is met by the adjustable connection link (122) of the adjustable rigging component (182), in particular by recess (133), and blocks further movement into the conduit (104) of adjustable rigging component (180). The adjustable connection link (122) is thus fixed in position between the ball lock pin (178) and the latch pin (76) and dimension (d) is thus stabilized for ground stacking.

Assembly of a Curved Array with Trapezoidal Array Elements

The assembly of a curved array using both fixed rigging components (10) and adjustable rigging components (100) will now be described.

Figure 19B:
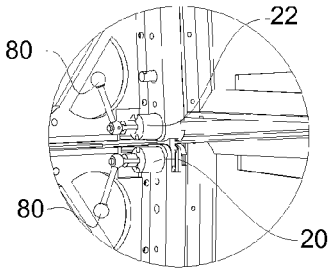
FIGS. 19*a* through 19*c* are isometric front views of a block of array elements with fixed rigging components attached thereto, and isolated portions thereof magnified.
Figure 19C:
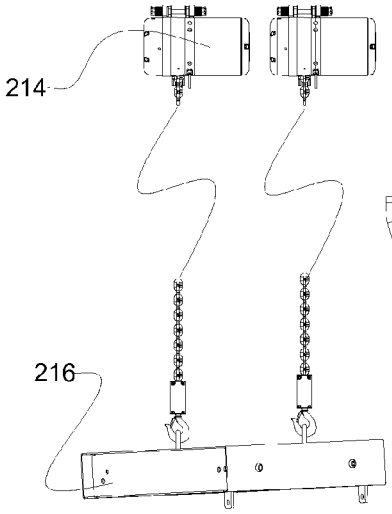
Figure 19C:
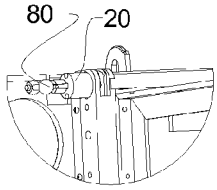
Figure 19A:
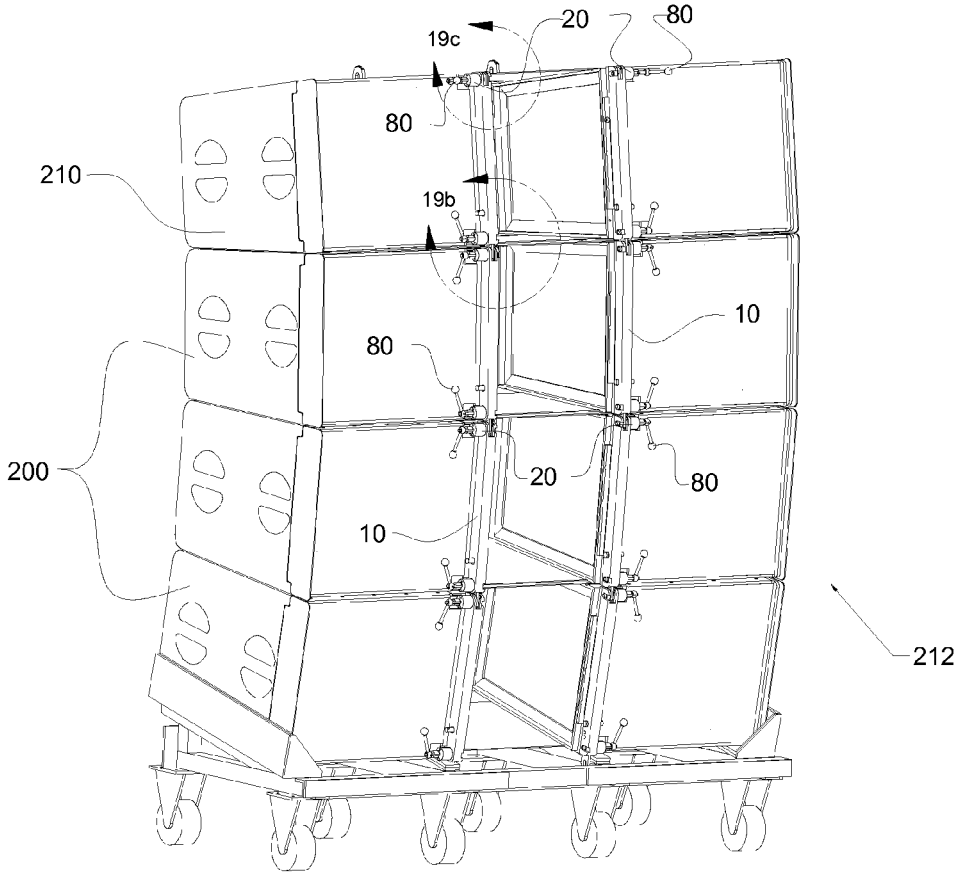

A frontal view of a first block (212) of trapezoidal array elements (200) prepared for array assembly is shown in FIG. 19*a*. Fixed rigging components (10) have been securely attached to respective array elements (200) and have been connected as described above to their adjacent fixed rigging components, with the associated latching mechanisms (20, 22) having been placed in respective engaged and locked positions as shown in FIGS. 19*b*, 10*e* and 7*a*. However, the lock handles (80) of the latching mechanisms (20) on the uppermost array element (210) of this first block (212) are placed in their disengaged and loaded positions as shown in FIGS. 19*c*, 10*d* and 7*b*.

Lifting mechanisms, which are, in this embodiment, chain hoists (214), are attached to a rigging frame (216) that is then suspended above the first block (212) of array elements (200).

Figure 20B:
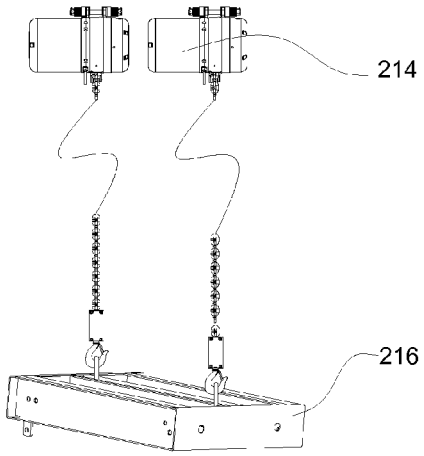
FIGS. 20*a* and 20*b* are isometric rear views of the block of array elements with adjustable rigging components attached thereto, and an isolated portion thereof.
Figure 20B:
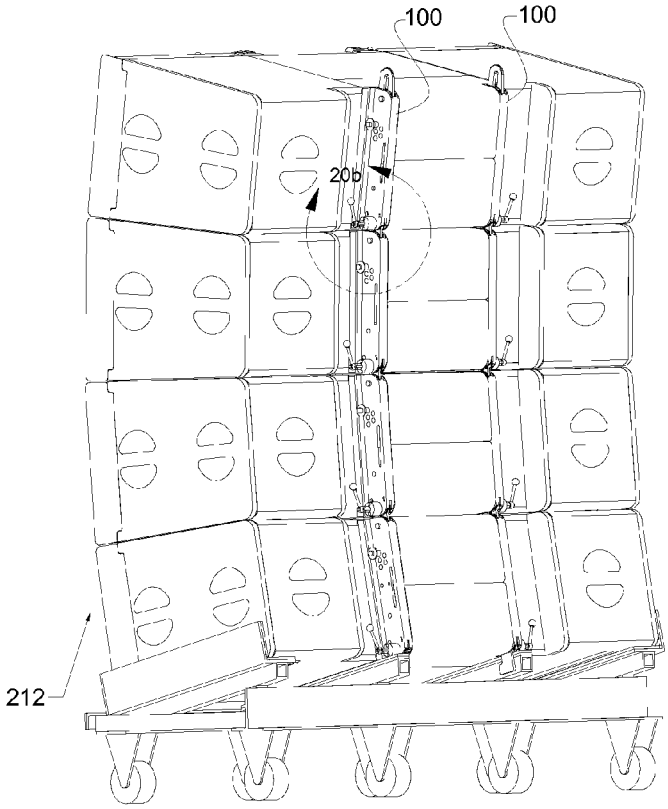
Figure 20A:
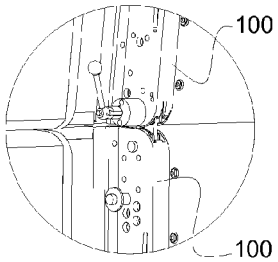

A rear view of the first block (212) of array elements (200) prepared for array assembly is shown in FIG. 20*a*. Adjacent adjustable rigging components (100) have been securely attached to respective array elements (200), have had their adjustable connection links (122) set at respective distances (d), and have been connected to their adjacent adjustable rigging components. The associated latching mechanisms have also been placed in respective engaged and locked positions as shown in FIG. 20*b*. In accordance with the automatic latching method, the adjustable connection links (122) for the adjustable rigging components attached to the uppermost array elements 210 are extended and fixed using the ball lock pins (170) at the desired distance (d) for the corresponding desired array element angle.

Figure 21A:
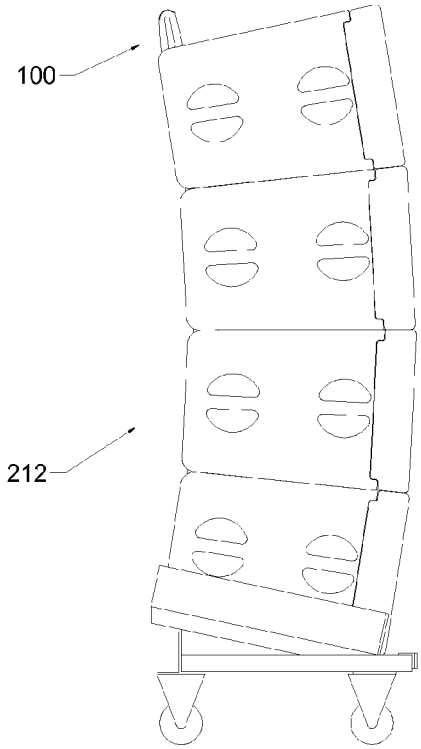
FIGS. 21*a*, 21*b*, 22, 23*a*, 23*b* and 24 are side views of the block of array elements being connected to an adjacent block of array elements during flying of an array.
Figure 21B:
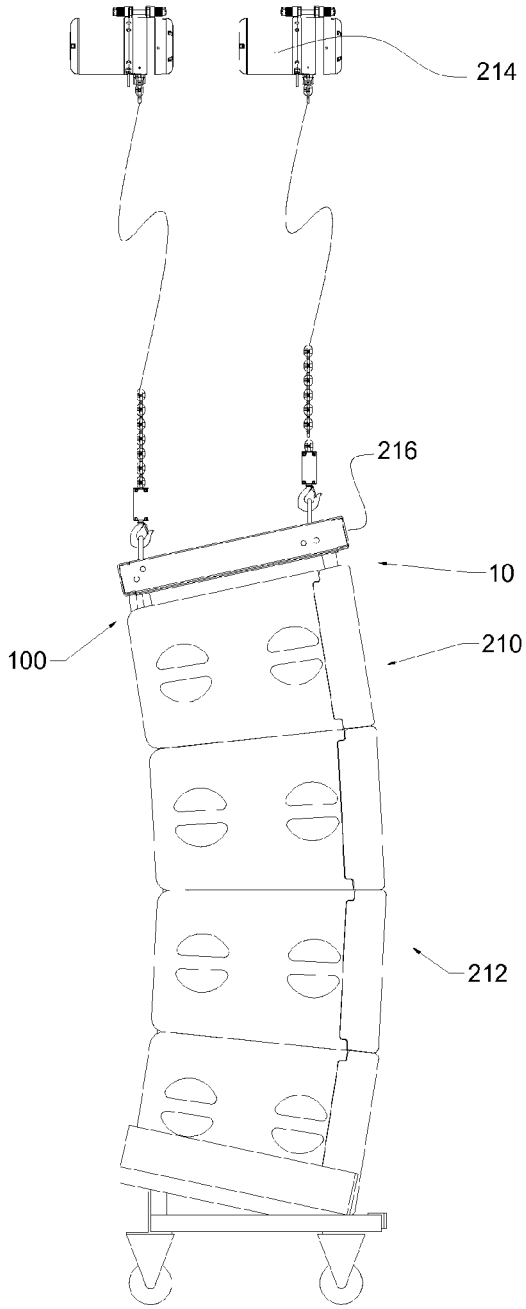

FIG. 21*a* is a side view of the first block (212) of array elements (200) prior to connection to the rigging frame (216). FIG. 21*b* shows the rigging frame (216) having been connected to both the fixed rigging components (10) and the adjustable rigging components (100) of the topmost array elements (210) in the first block (212).

Figure 22:
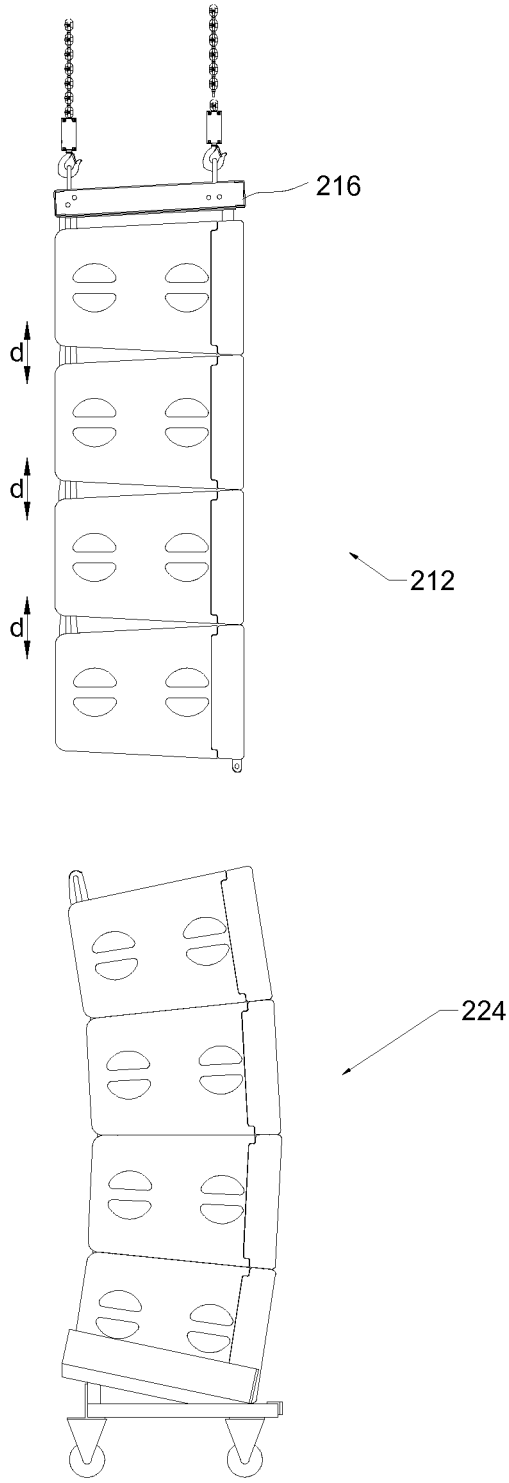

As shown in FIG. 22, the rigging frame (216) has been lifted by the chain hoists (214), which in turn lift the array elements (200). Upon lifting from their collapsed position, the array elements (200) in the first block (212) that have been lifted tilt front to back according to the distances (d) to which the adjustable connection links (122) of the adjustable rigging components (100) were set, facilitating the assembly of the array and setting the final angle of the suspended array. It will be understood that distances (d) may not necessarily be the same between each array element (200). Lifting by the chain hoists (214) continues until the first block (212) of array elements (200) is lifted clear of the top of a second block (224) of array elements (200).

Figure 23A:
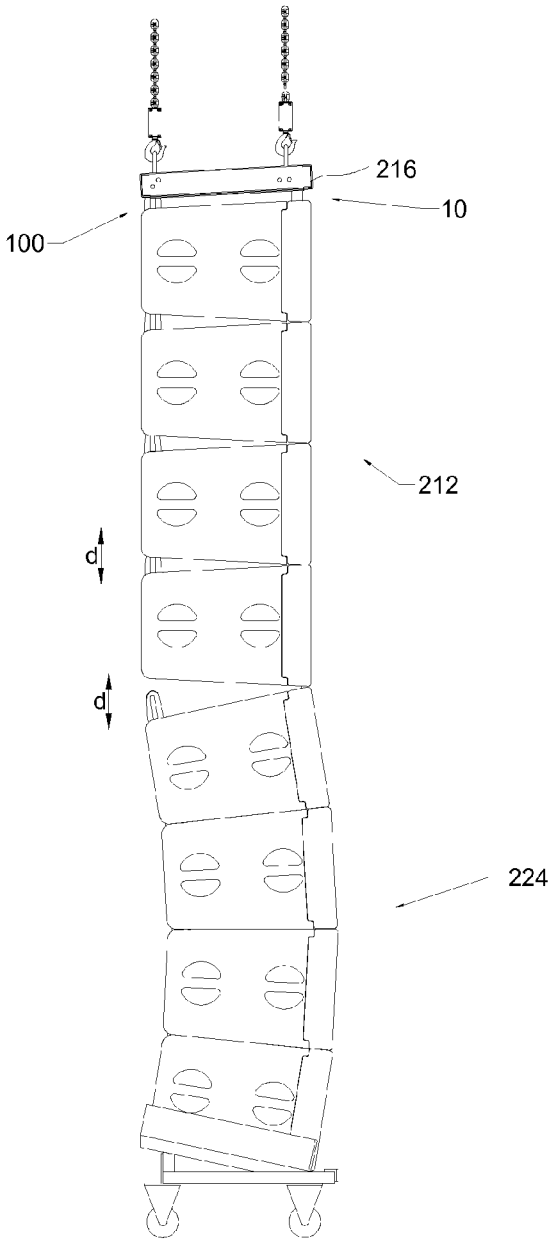
Figure 23B:
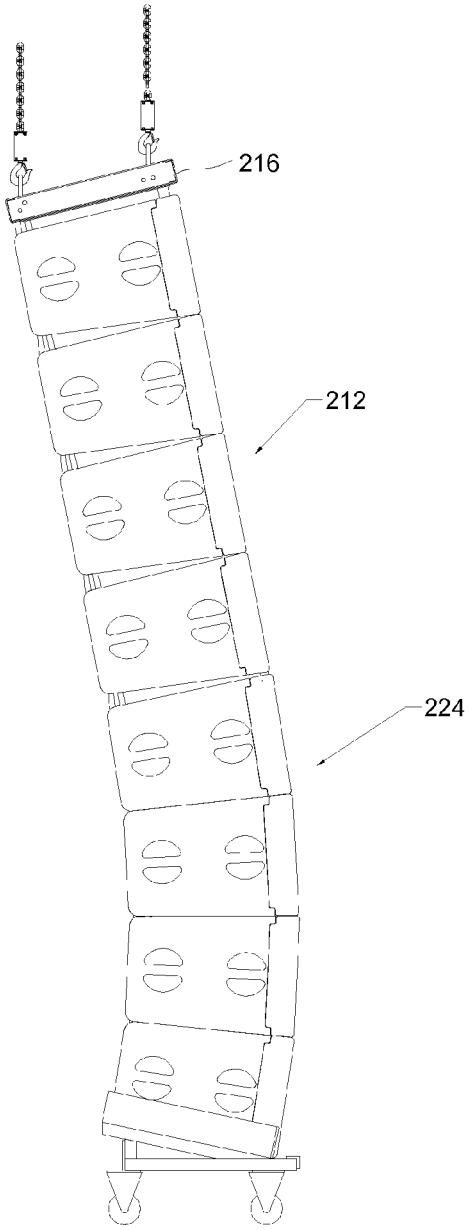

With the first block (212) of array elements (200) having been lifted clear of the top of a second block (224) of array elements (200), the first block of array elements (212) is then lowered towards the second block (224) as shown in FIG. 23*b*. During lowering, the fixed (10) and adjustable (100) rigging components of the first (212) and second blocks (224) are maintained in alignment so that the connection links (42, 122) may be accordingly inserted into the adjacent structural housings (12, 102). With the spring loaded locking mechanisms (70) in loaded and disengaged positions, once insertion has proceeded to the point that the retention devices (56, 138) unblock crossing of the latch pins (76) through respective conduits (13, 104), the spring loaded latch pins (76) pass similarly through respective ones of slot (130) and hole (52) to connect the first block (212) to the second block (224).

In most cases the assembly of a block of trapezoidal elements (200) into blocks (212, 224) on a dolly or on the ground in preparation for the assembly of a curved array will result in the front of the block at which the fixed rigging components (10) are attached being higher than the back of the block at which the adjustable components (100) are attached. Furthermore, a block (212) of suspended array elements (200) that is hung in a vertical position will have fixed rigging components (10) at the front of the block of elements that are lower than the adjustable rigging components (100) at the back of the block. As a result, when fixed rigging components (10) are brought together at the front of the array there is a considerable distance D between the corresponding adjustable rigging components (100) at the back of the array. This is also shown in FIG. 23*a*.

Figure 24:
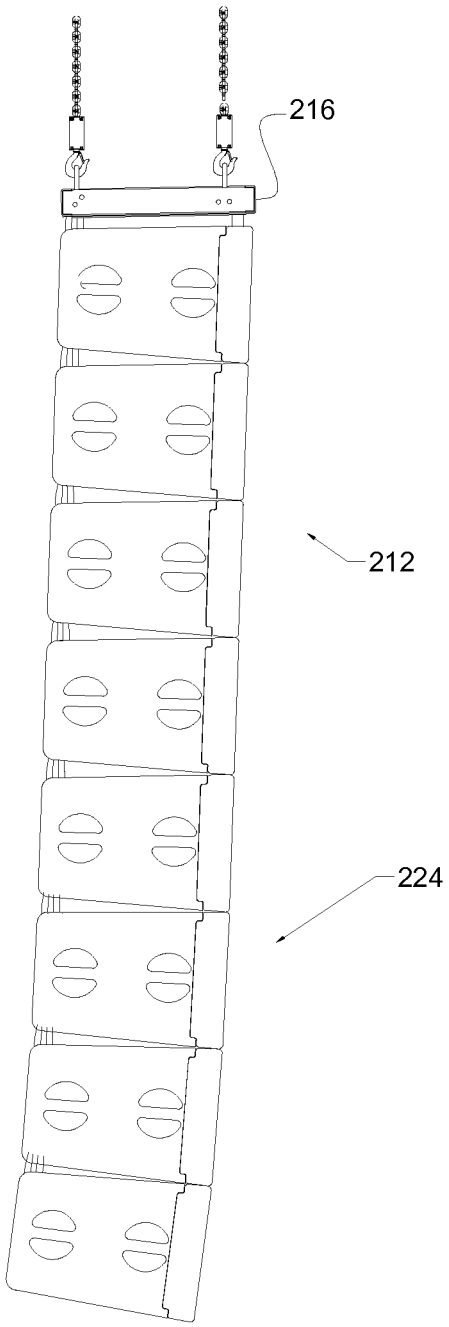
Figure 24:
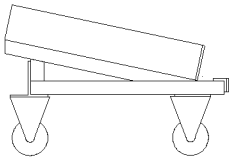

When the combined geometries of the array elements (200) and blocks (212, 224) thereof allow, a suspended block of array elements can be lowered further as shown in FIG. 23*b*. This permits the tilting back of the block (212), thereby closing the distance D between the corresponding adjustable rigging components (100) that are to be connected. Once connected, the combined block of array elements can be suspended as one unit, as shown in FIG. 24.

It will be understood that the extent to which a suspended block (212) can be further lowered and thus tilted back to be connected to another block (224) is determined by the curvature of the blocks (212, 224), the center of gravity of the entire suspended assembly and the location of the connection point of the front lifting device (214) to the rigging frame (216). As the suspended block is tilted backward, the weight of the block transfers to the front lifting device (214). When the weight is borne entirely by the front lifting device (214) it can be tilted no further.

While short arrays or those with limited curvature can be tilted and assembled as described above quite effectively, in order to tilt very long arrays or arrays with significant curvature additional steps are required.

Figure 25A:
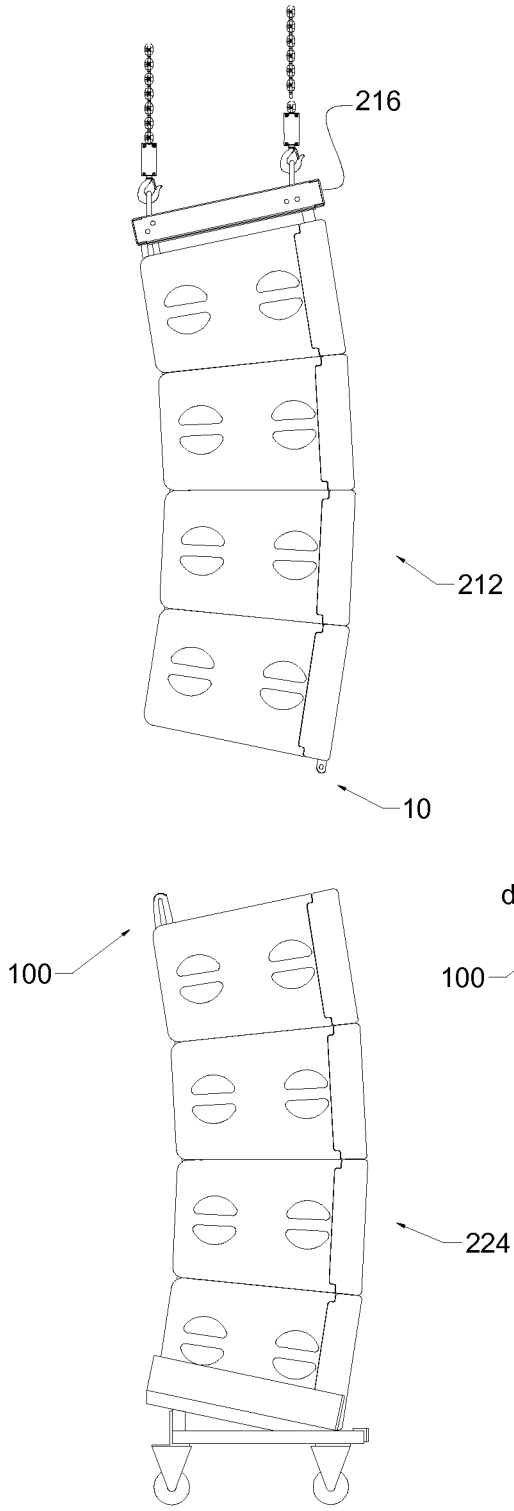
FIGS. 25*a*, 25*b*, 26*a*, 26*b*, 27*a* and 27*b* are side views of a block of array elements being connected in an alternative manner to an adjacent block of array elements during flying of an array.
Figure 25B:
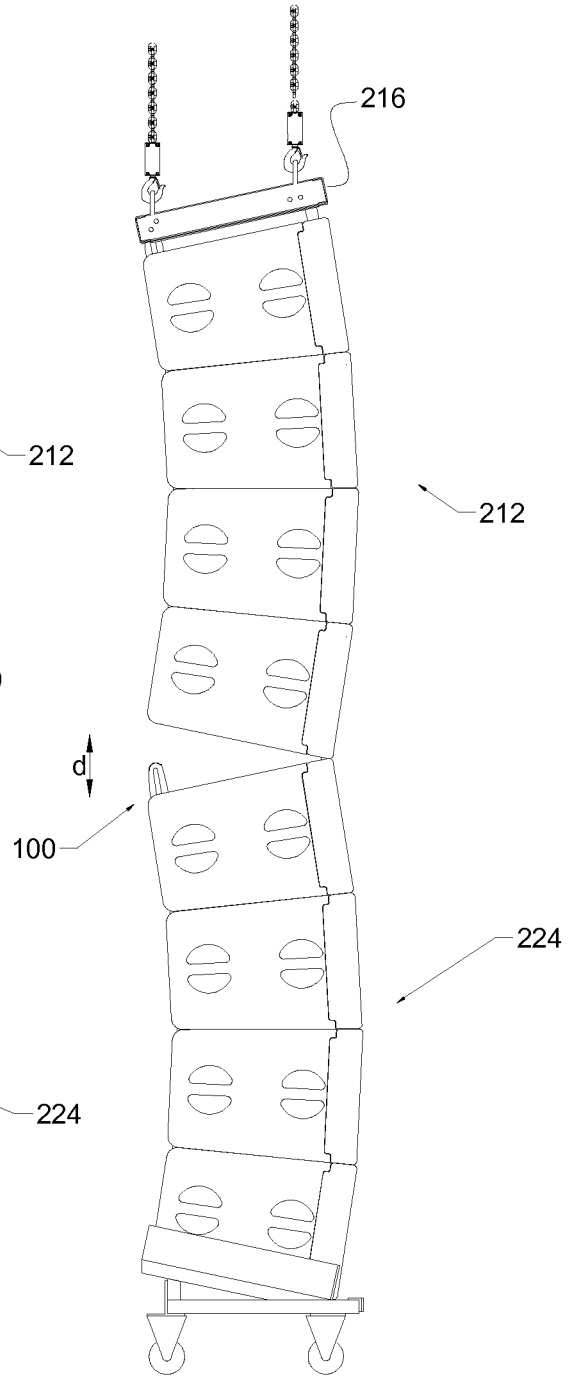

FIG. 25*a* shows a long suspended block (212) of array elements (200) that is adjusted to be tilted as far back as practical and that is positioned to be positioned above and connected to another block (224) of array elements below it. FIG. 25*b* shows that when the suspended block (212) is lowered to be adjacent to the lower block (224) of array elements, the distance D at the rear of the arrays cannot be closed completely unless the first block of array elements is tilted at an extreme angle.

In order to address this, the lock handles (80) of the adjustable rigging components (100) on the bottom array element (200) of the suspended block (212) are set to their disengaged and loaded position according to FIG. 10*b*.

Figure 26A:
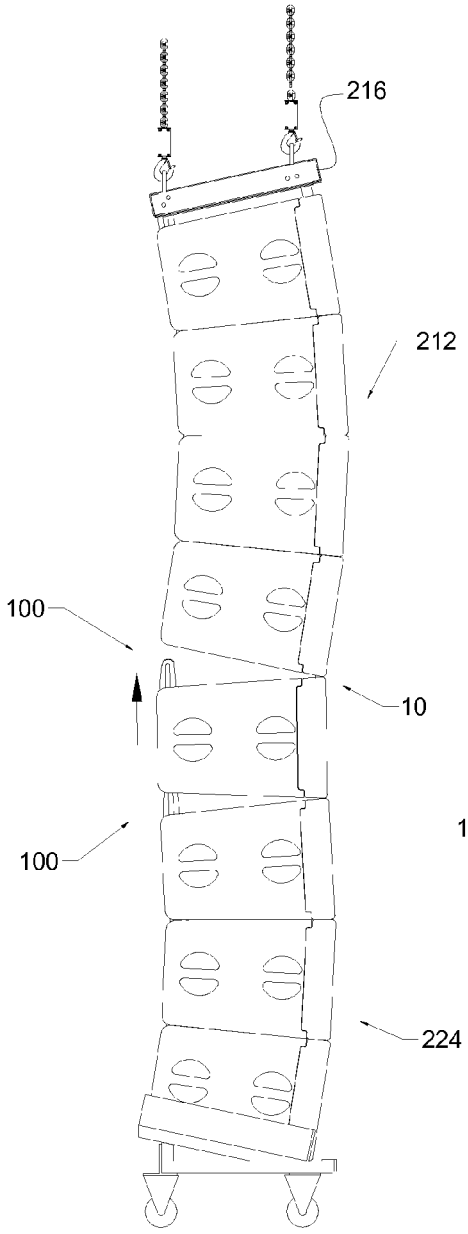

Next, the lock handles (80) of the adjustable rigging components (100) of the top element of the block (224) to be lifted are set to the disengaged and unlocked position as shown in FIG. 10*a*. Placing the lock handles (80) in the disengaged and unlocked position as shown in FIG. 10*a* frees the element so that it can be rotated about its fixed rigging components (10) upward manually as shown by the arrow in FIG. 26*a*.

As described above, rotation of the array element upwards causes the extended connection links (122) of the adjustable components (180) attached to the topmost array element on the block (224) to be lifted to enter the conduits (104) of the adjustable components (100) on the bottommost array element 200 in the block (212). The latch pins (76) of the spring loaded latching mechanisms thus latch the elements together, and the lock handles (80) are then rotated into their engaged and locked position as shown in FIGS. 10*e* and 7*a*.

Figure 26B:
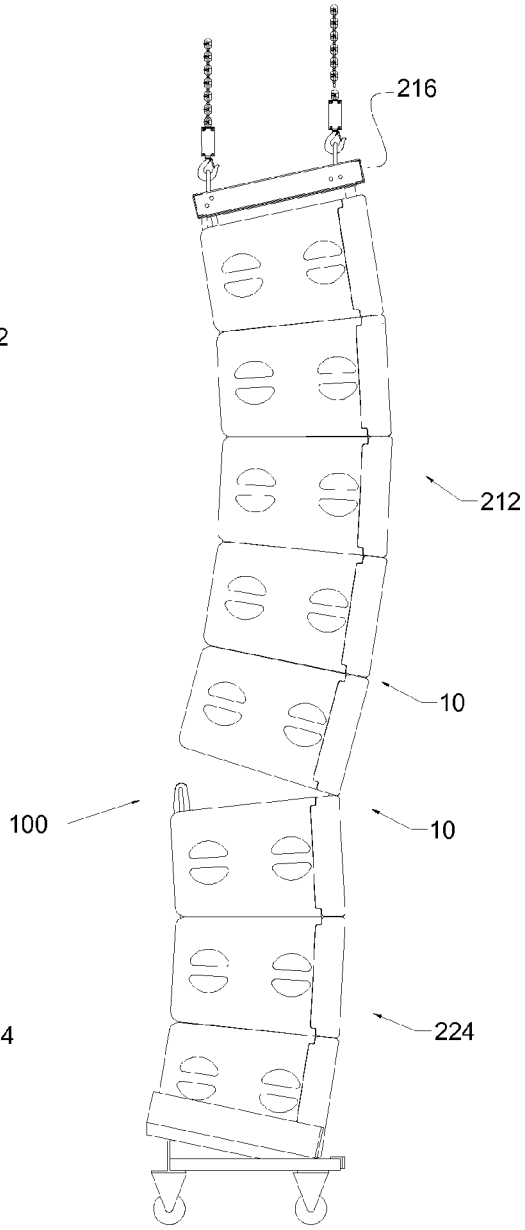
Figure 27A:
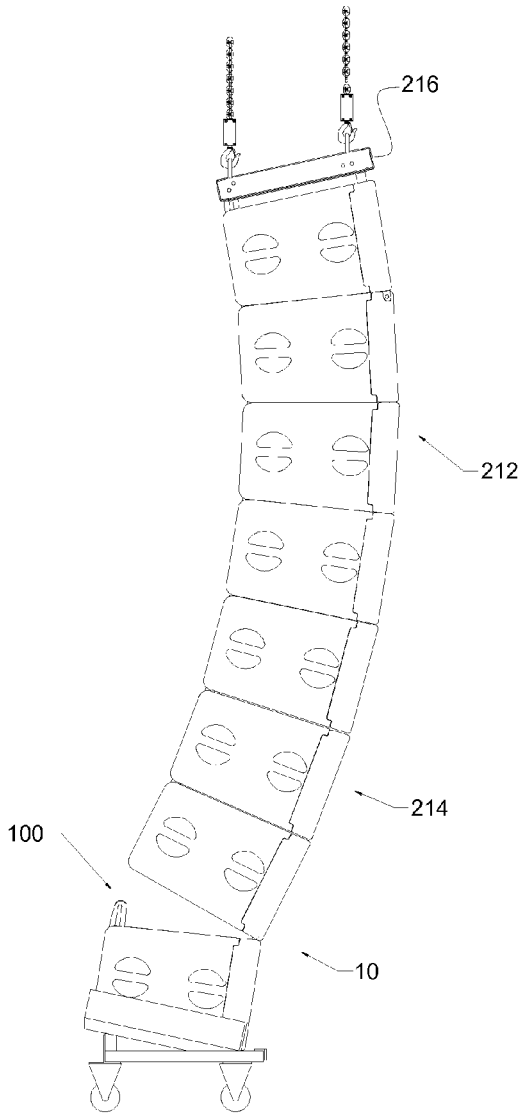
Figure 27B:
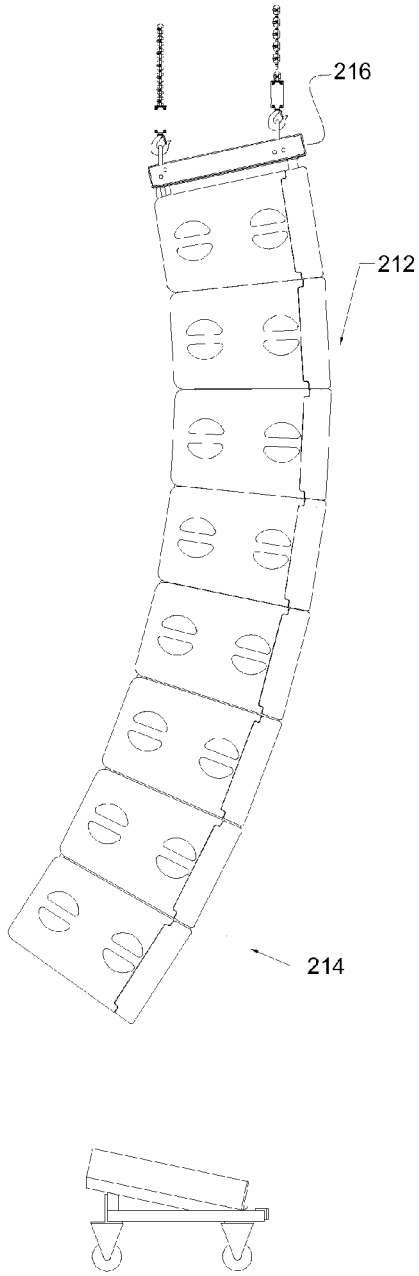

The above procedure is repeated for each array element (200) as shown in FIGS. 26*b*, 27*a* and 27*b*, until the entire array is complete and fully suspended Assembly of a Curved Array with Rectangular Array Elements Many manufacturers produce line array elements with a rectangular cross section. The chief difference between the trapezoidal and rectangular cross section is the location of the gap created due to the curvature of the array: with arrays of rectangular array elements, the gap is formed at the front of the rectangular element array. However, this configuration produces well-documented acoustical interference, and for at least this reason is not as popular as the trapezoidal array element.

Because the gap is formed at the front of such an array, it is therefore most likely that the adjustable rigging component (100) will be placed at or near the front of the array elements and the fixed rigging component (10) will be placed at the rear of the array elements. The result of the geometry is that a block of elements is rectangular when it is at rest and the rigging components are contracted to their storage position.

Assembly of a Straight Array with Rectangular Array Elements

A line array of low frequency array elements is most often arrayed in a straight line ie. without angles. The array element is therefore equipped with fixed rigging components (10) at both the front and back of the array element.

Blocks of array elements are prepared for array assembly with all connections between fixed rigging components securely engaged and locked. Each block is generally placed on a dolly for ease of use and transport.

The first step is to attach the rigging frame to the top of the block of array elements with the four latching mechanisms 20 on the uppermost element of the block.

The block is then lifted with the lifting mechanisms (214) until it is clear of the second block.

The connection links (42) of the fixed rigging components (10) of the lower element of the suspended block are then extended downward and locked in position by the latching mechanisms (70) with the handles (80) in the engaged and locked position as shown in FIGS. 10*e* & 7*a*.

The upper lock handles (80) of the latching mechanisms (70) on the top most element of the block are placed in the disengaged and loaded position as shown in FIGS. 18*c*, 10*d* & 7*b*.

The suspended block is then lowered by the lifting devices (214) while the fixed rigging components (10) of both the first and second blocks of elements are carefully aligned with one another.

When the extended connection links (42) at the bottom of the suspended block enter the conduits (13) of the fixed rigging components (10) at the top of the second block, the latch pins (76) of the latching mechanisms (70) are released and the array elements are thereby latched together. The procedure is repeated until the array is complete.

Although embodiments have been described, those of skill in the art will appreciate that variations and modifications are possible.

Figure 28A:
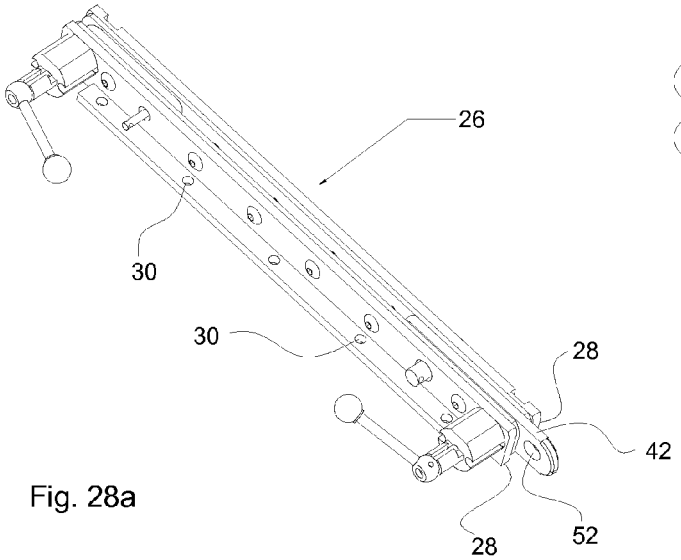
FIG. 28*a* is an isometric view of an alternative fixed rigging component having an integral latching mechanism.
Figure 28B:
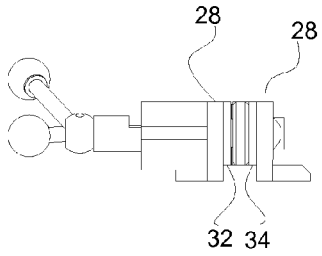
FIG. 28*b* is an end view of the alternative fixed rigging component of FIG. 28*a;*

For example, an alternative structural housing (28) may be cast or moulded to incorporate the body of a latching mechanism, as shown in FIGS. 28*a* and 28*b*. Alternatively, the latching mechanism could take the form of a typical ratchet element 0 that locks into a square bar.

Figure 29:
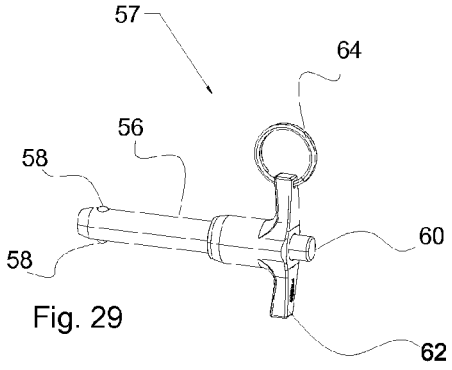
FIG. 29 is an isometric view of a spring ball locking pin.

Furthermore, although the latching mechanism (70) has been characterized with a spring loaded latch pin (76), alternative arrangements are possible in which a spring ball locking structural pin (57) as shown in FIG. 29 is employed. This type of pin uses an internal spring that forces two balls (58) on a shaft (56) outward to lock the pin (57) in position within a hole. The pin (57) is released by pressing a spring loaded plunger (60) in the center of the handle (62). The pin (57) can be attached with a cable through a ring (64) to its associated rigging component (10 or 100).

Figure 30:
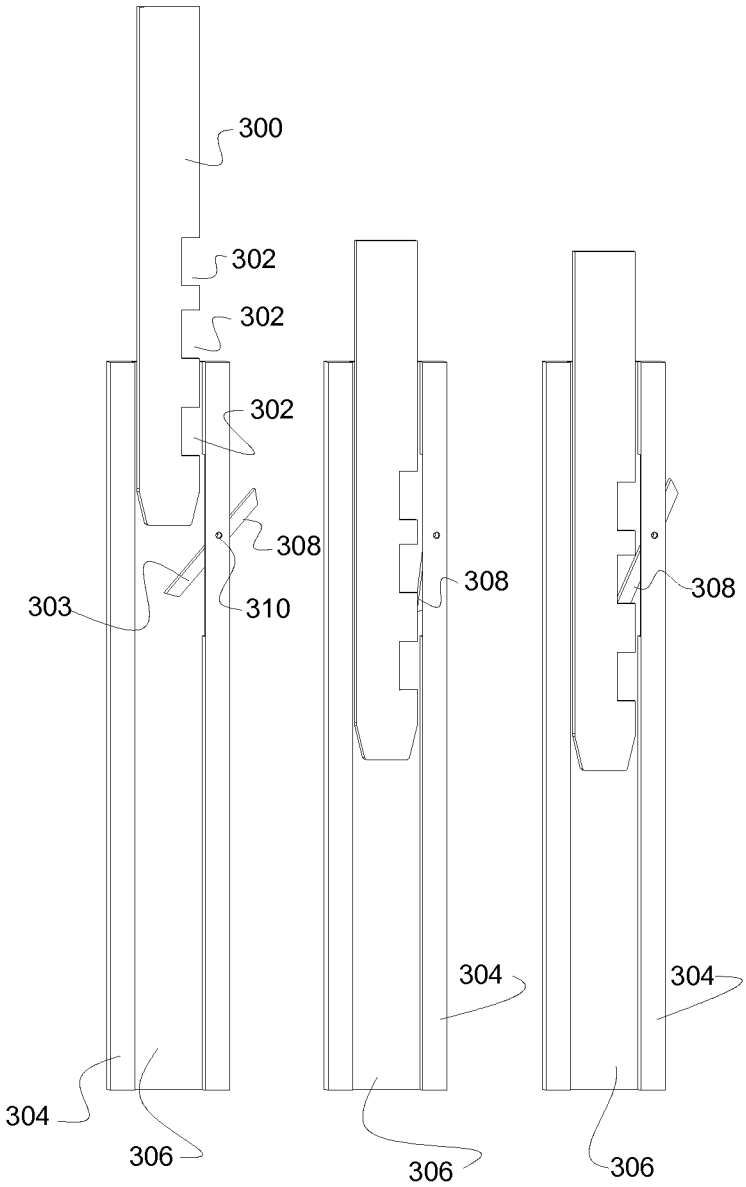
FIG. 30 is a schematic view of an alternative adjustable connection link and latching mechanism.

The extendible connection link may alternately take the form of a round or square bar (300) with holes or notches (302) and an associated housing (304) with an appropriately sized conduit (306) disposed within, as shown in FIG. 30. A latching mechanism may take the form of a ratchet lever (308) having a lock tooth (303), a lever (308) and a pivot (310) similarly used in industrial ratchet mechanisms. The ratchet lever (308) can be mounted through the side of housing (304) and caused to pivot within the wall of the housing (304) with the lock tooth (303) extending into the conduit (306) and the lever (308) extending outside the housing (304). The lever (308) can be spring loaded (not shown), such that as the square bar (300) is inserted into the conduit (306) the lock tooth (303) automatically snaps into one of the notches (302) in the bar (300). The bar (300) cannot be withdrawn from the conduit (306) unless the lever (308) is depressed causing the lock tooth (303) to withdraw into the wall of the housing (304).

Alternate embodiments might include a structural housing of a cast or moulded material either composite or metal that will permit the body of the latching mechanism to be incorporated into the structural housing.

Another alternate embodiment can be achieved with a housing that does not include an enclosed conduit but is formed from a flat bar or a channel and the links and mechanisms are attached to the bar by providing a combination of pins and holes that allow the movement of the functional parts in an exposed assembly. However, one disadvantage of such an approach is that the components in the exposed assembly would not be as well protected from contamination and damage as would the components in the enclosed assembly disclosed herein.

An alternate structural housing may also be cast, moulded or formed as an assembly of other common structural elements such as ell shaped pieces of steel or other metal which can be attached separately to the array element by holes in a flat back of the shaped metal to permit reception by the housing of bolts or screws.

In an alternate embodiment a retention device could be formed of a square bar that could block a ratchet mechanism from moving forward. According to this embodiment, when a connection device made of a square bar of the same size enters the structural housing and pushes the retention device further into the housing, the ratchet type latching mechanism can lock into a notch in the connection device.

Although embodiments have been described, those of skill in the art will appreciate that variations and modifications may be made without departing from the purpose and scope thereof as defined by the appended claims.

What is claimed is:

1. A rigging component for connecting an array element in an array, the rigging component comprising:

an elongate housing connectable to an array element;

a connection link disposed within, and slidably extendable from, one end of the housing;

a conduit extending into the housing from its opposite end, the conduit dimensioned to receive another connection link extending from an adjacent rigging component;

at least one latching device associated with the conduit for releasably retaining the other connection link within the conduit; and a movable retention device associated with the conduit and the latching device, wherein the retention device is configured to be displaced when the other connection link is received within the conduit, and wherein the latching device is configured to automatically engage with the other connection link when the retention device is displaced.

2. The rigging component of claim 1, wherein the connection link comprises at least one aperture therethrough that is exposed when the connection link is extended from the one end of the housing.

3. The rigging component of claim 1, wherein the latching device comprises a pin that, in a latching position, passes through both the conduit and a hole in the other connection link.

4. The rigging component of claim 3, wherein the latching device further comprises a retention spring to bias the pin towards the latching position.

5. The rigging component of claim 4, wherein the retention device is disposed within the conduit for blocking passage of the pin through the conduit until the other connection link is inserted into the conduit to displace the retention device.

6. The rigging component of claim 5, further comprising a spring biased to maintain the retention device in a blocking position.

7. The rigging component of claim 1, wherein the conduit extends from the one end of the housing to the opposite end, and the connection link is slidably extendable from within the conduit.

8. The rigging component of claim 7, wherein the connection links are configured to slide between hardened steel bars within the conduit.

9. The rigging component of claim 8, wherein the housing is formed from aluminum.

10. The rigging component of any of claims 1 through 9, wherein the connection link is extendable to be locked at a single fixed distance.

11. The rigging component of any of claims 1 through 9, wherein the connection link is extendable to be locked at one of a plurality of fixed distances.

12. An array element configured for connection to one or more additional array elements, the array element comprising:

at least one first rigging component, as defined by claim 1, wherein the connection link is extendable to be locked at a single fixed distance; and at least one second rigging component, as defined by claim 1, wherein the connection link is extendable to be locked at one of a plurality of fixed distances.

13. An array element configured for connection to one or more additional array elements, the array element comprising:

at least two rigging components as defined by claim 10.

14. A method for connecting first and second array elements to each other, first method comprising:

providing a first array element and a second array element according to claim 12;

extending and locking at a selected fixed distance the connection link of the at least one second rigging component attached to the second array element;

extending and locking at the single fixed distance the connection link of the at least one first rigging component attached to the first array element; and bringing the first array element towards the second array element until corresponding rigging components interconnect and automatically latch, thereby connecting the first and second array elements to each other.

15. The method of claim 14, wherein corresponding second rigging components interconnect prior to the corresponding first rigging components.

16. The method of claim 15, wherein during bringing the first array element towards the second array element, the first array element is lowered towards the second array element from above the second array element, the method further comprising:

in the event that further lowering after the second rigging components have interconnected will tip the first and second array elements at an undesirable angle, rotating the second array element upwards about the interconnection between the second rigging components to interconnect the first rigging components.

17. The method of claim 16, wherein in the event that the second array element is already connected to a third array element opposite the first array element, the method comprises:

prior to the rotating, releasing the interconnection between the first rigging components of the second and third array elements; and after the rotating, reinstating the interconnection between the first rigging components of the second and third array elements.

18. The rigging component of claim 1 wherein the retention device is configured to undergo translation when the other connection link is received within the conduit.

19. The rigging component of claim 1 wherein the retention device is configured to undergo rotation when the other connection link is received within the conduit.

20. The rigging component of claim 1 wherein the latching device further comprises a locking mechanism for locking the engagement of the latching device with the other connection link.

21. The rigging component of claim 6 wherein the latching device further comprises:

a rotatable handle connected to the pin for rotating the orientation of the pin;

a locking stud extending laterally from the pin; and a body configured to receive the pin axially therethrough;

wherein an outer surface of the body comprises a notch, and wherein the notch is configured to receive the locking stud and lock the axial position of the pin.

22. The rigging component of claim 21 wherein the notch comprises:

a longitudinal portion configured to receive the locking stud and permit axial passage of the pin within the body to permit engagement of the pin with the other connection link; and an azimuthal portion in communication with the longitudinal portion, wherein the azimuthal portion is configured to receive the locking stud for locking an axial position of the pin when the pin is engaged with the other connection link.

23. A rigging component for connecting an array element in an array, the rigging component comprising:

an elongate housing connectable to an array element;

a connection link disposed within, and slidably extendable from, one end of the housing;

a conduit extending into the housing from its opposite end, the conduit dimensioned to receive another connection link extending from an adjacent rigging component; and an automatic latching means associated with the conduit for automatically retaining the other connection link within the conduit when the other connection link is received within the conduit.

24. The rigging component of claim 23 wherein the automatic latching means further comprises a locking mechanism for locking the engagement of the automatic latching means with the other connection link.

* * * * *